US008258900B2

(12) United States Patent
Christenson

(10) Patent No.: US 8,258,900 B2
(45) Date of Patent: Sep. 4, 2012

(54) MINIATURIZED SWITCH DEVICE

(75) Inventor: Todd Richard Christenson, Albuquerque, NM (US)

(73) Assignee: HT Microanalytical, Inc., Albuquerque, NM (US)

( * ) Notice: Subject to any disclaimer, the term of this patent is extended or adjusted under 35 U.S.C. 154(b) by 75 days.

(21) Appl. No.: 13/028,855

(22) Filed: Feb. 16, 2011

(65) Prior Publication Data

US 2011/0140814 A1 Jun. 16, 2011

Related U.S. Application Data

(63) Continuation of application No. 11/367,890, filed on Mar. 3, 2006, now Pat. No. 7,999,642.

(60) Provisional application No. 60/658,902, filed on Mar. 4, 2005, provisional application No. 60/658,957, filed on Mar. 4, 2005.

(51) Int. Cl.
*H01H 51/22* (2006.01)

(52) U.S. Cl. ..... 335/78; 200/181; 335/205

(58) Field of Classification Search ..... 335/78; 200/181

See application file for complete search history.

(56) References Cited

U.S. PATENT DOCUMENTS

| | | | | |
|---|---|---|---|---|
| 6,094,116 | A | 7/2000 | Tai et al. | |
| 6,310,526 | B1 * | 10/2001 | Yip et al. | 333/262 |
| 6,366,186 | B1 | 4/2002 | Hill et al. | |
| 6,809,412 | B1 | 10/2004 | Tourino et al. | |
| 6,894,592 | B2 | 5/2005 | Shen et al. | |
| 6,975,193 | B2 | 12/2005 | Knieser et al. | |
| 7,902,946 | B2 * | 3/2011 | Niblock | 335/78 |
| 2003/0030998 | A1 | 2/2003 | Mhani et al. | |
| 2003/0122640 | A1 | 7/2003 | Deligianni et al. | |
| 2003/0137374 | A1 * | 7/2003 | Ruan et al. | 335/78 |
| 2003/0210115 | A1 | 11/2003 | Kubby et al. | |
| 2006/0049900 | A1 * | 3/2006 | Ruan et al. | 335/78 |

FOREIGN PATENT DOCUMENTS

EP 1191559 A2 3/2002

OTHER PUBLICATIONS

Socher, Guenther, "EP Application No. 06737141.9 European Search Report Mar. 31, 2011", , Publisher: EPO, Published in: EP.

Rojas, Bernard, "U.S. Appl. No. 11/367,890 Notice of Allowance Apr. 18, 2011", , Publisher: USPTO, Published in: US.

Deue, Lydia, "PCT Application No. PCT/US2006/07926 International Preliminary Report on Patentability Sep. 12, 2007", , Publisher: PCT, Published in: PCT.

Deue, Lydia , "PCT Application No. PCT/US2006/07926 International Search Report Apr. 25, 2007", , Publisher: PCT, Published in: PCT.

Rojas, Bernard, "U.S. Appl. No. 11/367,890 Office Action Dec. 23, 2010", , Publisher: USPTO, Published in: US.

(Continued)

*Primary Examiner* — Bernard Rojas

(74) *Attorney, Agent, or Firm* — Kaplan Breyer Schwarz & Ottesen LLP

(57) ABSTRACT

The present invention provides a switch suitable for efficient microfabrication. The switch elements are disposed in several layers. Various embodiments provide various switching capabilities and operational characteristics. The switches can be protected by suitable packaging, and can be efficiently fabricated in groups or arrays.

20 Claims, 33 Drawing Sheets

OTHER PUBLICATIONS

Rojas, Bernard, "U.S. Appl. No. 11/367,890 Office Action Jan. 4, 2010", , Publisher: USPTO, Published in: US.
Rojas, Bernard, "U.S. Appl. No. 11/367,890 Office Action May 29, 2009", , Publisher: USPTO, Published in: US.
Rojas, Bernard, "U.S. Appl. No. 11/367,890 Office Action Jul. 7, 2010", , Publisher: USPTO, Published in: US.
Rojas, Bernard, "U.S. Appl. No. 11/367,890 Restriction Requirement Sep. 15, 2008", , Publisher: USPTO, Published in: US.

* cited by examiner

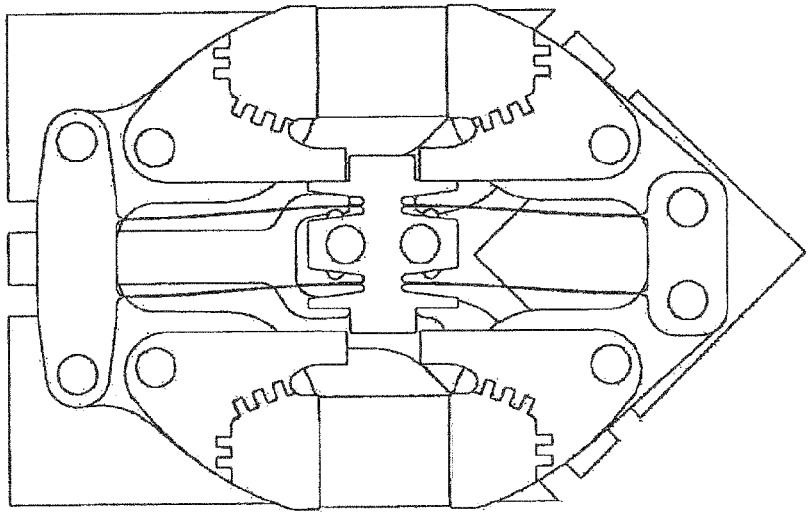
FIGURE 35f
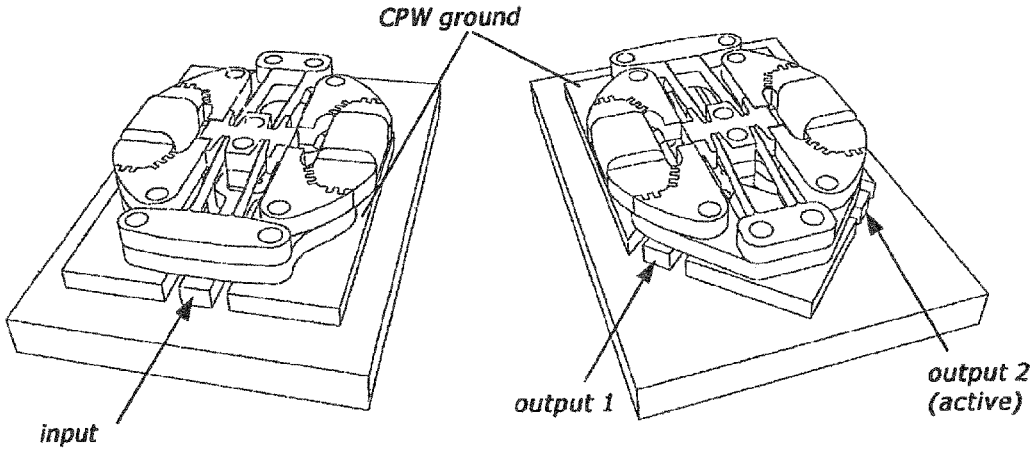
FIGURE 35g
FIGURE 35h

MINIATURIZED SWITCH DEVICE

CROSS-REFERENCE TO RELATED APPLICATIONS

This case is a continuation of co-pending U.S. patent application Ser. No. 11/367,890, filed Mar. 3, 2006, which claims the benefit of U.S. Provisional Application Ser. No. 60/658,957, filed on Mar. 4, 2005 and U.S. Provisional Application Ser. No. 60/658,902, filed on Mar. 4, 2005, all of which are incorporated herein by reference.

FIELD OF THE INVENTION

This invention relates to the field of miniaturized devices, and more specifically relates to the fields of switches and safing devices.

BACKGROUND OF THE INVENTION

Switching Devices. Micromechanical devices (sometimes known as MEMS devices) have been known for many years, and various switch designs have been proposed using MEMS technology. However, the designs presently available still have shortcomings. For example, none has proven suitable for switching high power radio frequency signals (e.g., 5 W of RF power at 0.1-6 GHz). It is generally considered essential to obtain a large contact force for reliable high-power switches, and this can only be done currently using thermal actuation. Cronos (later JDS Uniphase) developed a thermal actuation switch beginning in 1999 with low insertion loss and high isolation at 0.1-6 GHz [RF MEMS: Theory, Design and Technology, John Wiley and Sons, February 2003; R. Wood, R. Mahadevan, V. Dhuler, B. Dudley, A. Cowen, E. Hill, and K. Markus, MEMS microrelays, Mechatronics, Vol. 8, pp. 535-547, 1998]. This switch resulted in about 1 mN of contact force per contact, used a pure gold contact, and was tested up to 25 W for 50 million cycles in a tunable 50 MHz filter by the Raytheon group with no failures [R. D. Streeter, C. A. Hall, R. Wood, and R. Madadevan, VHF high-power tunable RF bandpass filter using microelectromechanical (MEM) microrelays, Int. J. RF Microwave CAE, Vol. 11, No. 5, pp. 261-275, 2001; Charles A. Hall, R. Carl Luetzelschwab, Robert D. Streeter, and John H. VanPatten, "A 25 Watt RF MEM-tuned VHF Bandpass Filter," IEEE Int. Microwave Symp., pp. 503-506, June 2003]. However, the switch consumed 250 mW of continuous DC power for operation, and the tunable filter with 8 actuated switches on average required 2 Watts of DC control power. The University of California, Davis, improved the Cronos design by using a more efficient thermal actuator and dropped the drive power from 250 mW to 60-70 mW for a 0.5 mN of contact force [Y. Wang, Z. Li, D. T. McCormick, and N. C. Tien, Low-voltage lateral-contact microrelays for RF applications, in 15th IEEE International Conference on Micro-Electro-Mechanical Systems, January 2002, pp. 645-648]. While an improvement over the previous design, this was still not acceptable for phased arrays and complicated switch networks. The Cronos switch was not used by the DoD or commercial community due to its high control power, but it demonstrated that acceptable switch performance can be obtained with 1-2 mN of contact force per contact.

Some designs reduce the required control power with a latching switch. In a latching switch, the control power is activated for only 0.3-3 milliseconds. This can be suitable for slow scanning phased arrays on unmanned air vehicles or in satellite systems. A latching switch also keeps its state if the power is temporarily lost (or purposely removed), which can be a great advantage in set-and-forget systems such as large switch networks for automated testing of defense and commercial systems, or in satellite applications with large pipeline switch networks. A principal component of many latching switch designs is a bi-stable spring and actuation mechanism. A switch by Magfusion (formerly Microlab) is rated to 10 mA only for 10 million cycles [RF MEMS: Theory, Design and Technology, John Wiley and Sons, February 2003, M. Ruan, J. Shen, and C. B. Wheeler, Latching Micromagnetic Relays, IEEE J. Microelectromech. Systems, Vol. 10, pp. 511-517, December 2001. Also, see www.magfusion.com] since it has low contact forces, of the order of 0.1 mN and uses a gold contact. Thermal latching switches by Michigan (and MIT) have not yet seen commercial acceptance [Long Que, Kabir Udeshi, Jaehyun Park, and Yogesh B. Gianchandani, "A BI-STABLE ELECTRO-THERMAL RF SWITCH FOR HIGH POWER APPLICATIONS," IEEE Conf. on Micro-electro-mechanical Systems, pp. 797-800, January 2004; J. Qiu, J. H. Lang, A. H. Slocum, R. Strümpler, "A High-Current Electrothermal Bistable MEMS Relay," MEMS'03, pp. 64-67, 2003]. Latching-type switches are generally quite large due to the bi-stable spring used, and therefore are not generally suited for high microwave or mm-wave operation.

Another set of RF MEMS switches include the Radant MEMS metal-contact switch with electrostatic actuation [S. Majumder, J. Lampen, R. Morrison and J. Maciel, "A Packaged, High-Lifetime Ohmic MEMS RF Switch," IEEE MTT-S Int. Microwave Symp., pp. 1935-1938, June 2003], and the Raytheon capacitive switch [RF MEMS: Theory, Design and Technology, John Wiley and Sons, February 2003], also with electrostatic actuation. Both are very small, have been taken to mm-wave frequencies, and have been tested for at least 20 Billion cycles and in some cases to 100 Billion cycles. However, the Radant switch results in 0.1 mN of contact forces and cannot handle 5 W of RF power, and the Raytheon capacitive switch is not suitable for 0.1-6 GHz applications:

Current switch designs suffer from various shortcomings, which have so far precluded development of a high-power latching RF MEMS switch.

Sating Devices. In order to prevent an energetic material used in a rocket motor, warhead, explosive separation device or other similar device, collectively sometimes referred to as "target devices", from being unintentionally operated during handling, flight or in any circumstance that could produce an extreme hazard to personnel or facilities, a "sating device" is customarily incorporated in the firing control circuit for the foregoing devices as a safety measure. These generically fall into two categories: "arm/fire" and "safe and arm". The arm/fire device electrically and/or mechanically interrupts the "ignition train" to the target device so as to prevent accidental operation. The arm/fire device includes a mechanism that permits the target device to be armed, ready to fire, only while electrical power is being applied to the target device. When that electrical power is removed, signifying the target device is disarmed, the mechanism of the arm/fire device returns to a safe position, interrupting the path of the ignition train.

The safe and arm device is of similar purpose, and is a variation of the arm/fire device. The mechanism of the safe and arm device enables the target device, such as the rocket motor, warhead and the like, earlier mentioned, to remain armed, even after electrical power is removed. The device may be returned to a "safe" position only by applying (or reapplying) electrical power. The safe and arm device is commonly used to initiate a system destruct in the event of a test failure, for launch vehicle separation and for rocket motor stage separation during flight. Typically, the safe and arm device uses a pyrotechnic output which may be either a subsonic pressure wave or which may be a flame front and supersonic shock wave or detonation to transfer energy to another pyrotechnic device (and serves as the trigger of the latter device).

Existing safety devices are typically of the size of a person's fist, and possess a noticeable weight of several pounds. Although MEMS and other microfabrication technologies have been brought to bear on such sating devices, it has been primarily in the area of the ignition device that initiates the ignition train or in only a portion of the mechanism. There are currently no completely microfabricated safing devices available. Microfabrication of a safing device can allow significant reduction of weight, volume and cost. Reduction of weight and volume of those devices can allow corresponding increases in weight and/or volume of payload and propulsion systems resulting in increased range and capability of a weapon system. Reduced size and cost can allow the safing of small munitions or sub-munitions that are currently not provided with safing systems.

SUMMARY OF THE INVENTION

The present invention provides a switch having a base layer, a moveable member layer substantially parallel to the base layer, and first and second terminals. Motion of the moveable member parallel to the base layer opens and closes an electrical connection between the first and second terminals. Embodiments of the present invention comprise a third terminal, with an electrical connection between the first terminal and either the second or third terminal established by motion of the moveable member. Embodiments also comprise fourth terminals, with motion of the moveable member completing an electrical connection between the first and second terminals, or completing an electrical connection between the third and fourth terminals.

Embodiments of the present invention provide contacts mounted with the moveable member, such that motion of the moveable member moves the contacts into electrical communication with each other. The contacts can also move substantially parallel to the base layer, and can be disposed in the moveable member layer or in another layer. Embodiments of the present invention comprise a bistable moveable member, such that, once moved to a configuration that either opens or closes a particular electrical connection, the moveable member will remain in that configuration until external energy is applied. The bistability is provided in some embodiments by a flexure having buckled states, or a beam or beams mounted with the moveable member.

The force desired to move the moveable member can be provided by one or more electrostatic actuators, comb drives, electrostatic actuators, thermal actuators, piezoelectric actuators, pneumatic actuators, or other actuators suitable for the forces desired and the desired assembly process. Embodiments of the present invention also provide for isolation between the actuation and the switched circuit, for example by an insulating layer disposed between a layer containing the switched circuit and a layer containing an electromagnetic actuator. Embodiments of the present invention can comprise a plurality of switched disposed on a single substrate, or stacked together. Separator structures and lids can be used in some embodiments to protect the switch from external influences such as dust or debris. Vias through the base layer can be used to allow convenient external electrical connection.

Advantages and novel features will become apparent to those skilled in the art upon examination of the following description or may be learned by practice of the invention. The advantages of the invention may be realized and attained by means of the instrumentalities and combinations particularly pointed out in the appended claims.

BRIEF DESCRIPTION OF THE DRAWINGS

FIG. 24(*b*) is a detailed view of the magnetic circuit elements of the shutter layer with the shutter in "armed" mode.

DETAILED DESCRIPTION OF THE INVENTION

Example Switch Embodiments

The present invention comprises a number of embodiments of switches that provide desirable performance characteristics and are suitable for efficient microfabrication. Some embodiments of the present invention provide one or more of the following advantages over previous approaches: electromagnetically actuated; self-latching, requiring no quiescent DC power; Low voltage (<2 V) and low current (<40 mA) actuation; capable of high contact forces (1-2 mN per contact); capable of high RF power handling (at least 5 W); extremely linear with very low intermodulation products; low sensitivity to temperature, shock, acceleration, and aging; easy to package in hermetic and near hermetic conditions; capable of very high isolation for 0.1-6 GHz applications.

Figure 1:
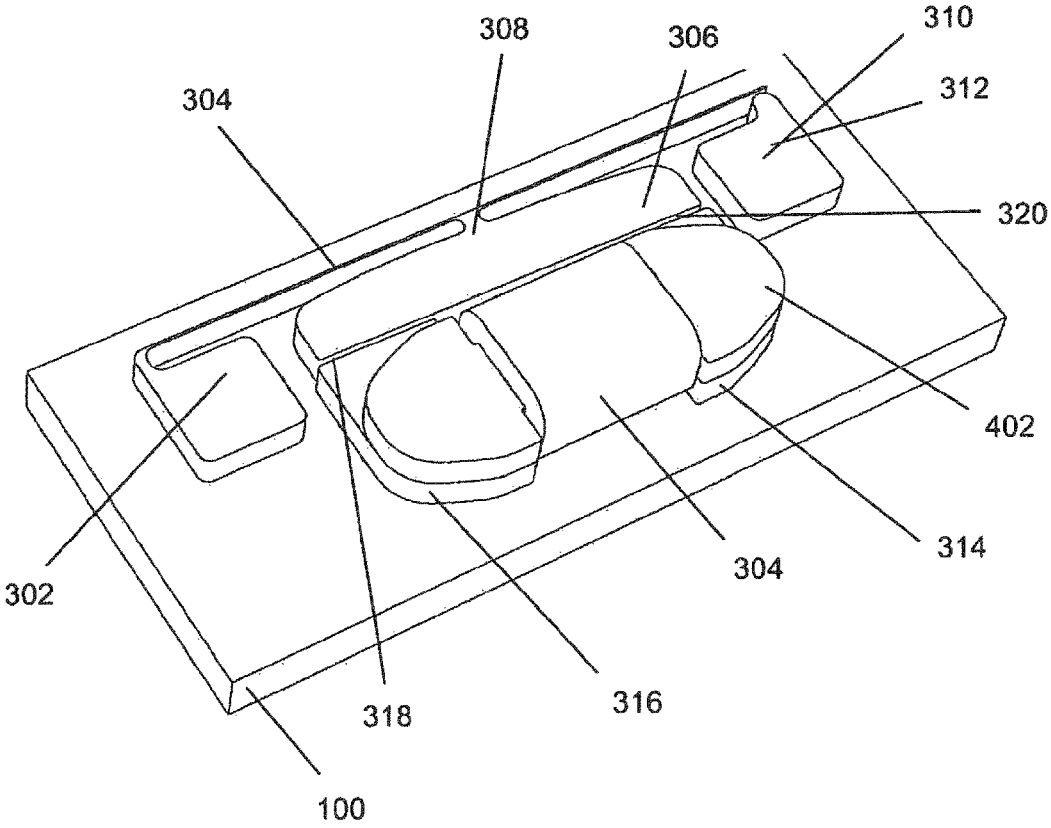
FIG. 1 is an illustration of an example embodiment of an SPST (single pole single toggle) electromagnetic switch realized in four layers.

FIG. 1 is a perspective view of a single pole single toggle (SPST) switch embodiment of the present invention. A substrate 100 can comprise an electrically insulating material, and provides a base layer for the switch. Electrically conducting input 302 and output 312 pads mount with the substrate such that the pads are electrically isolated from each other. An armature or movable member 308 is disposed in a second layer, and mounts with a supporting spring 304 cantilevered from the input pad 302 such that the movable member is able to move substantially in the plane of the second layer, parallel to the base layer. An electrically conductive contact spring 306 mounts with the movable member 308. First and second magnetic poles 314, 316 and a magnetic core 402 can all comprise soft ferromagnetic material. The poles 314, 316 and core 402 become magnetized when coil 304 is energized with electrical current. The current induces a magnetic field in the movable member 308 and the gaps formed between the movable member 308 and the magnetic poles 318, 320. The magnetic field creates an attractive force between the movable member 308 and the magnetic poles 314, 316, urging the movable member 308 closer to or in contact with the poles. The motion of the movable member 308 also causes motion of the connected contact spring 306 in a manner to close the electrical contact gap 316 and make electrical connection between electrical pads 302, 312 through the armature spring 304 and the Contact spring 306. The spring elements can be formed such that their width is substantially less than their height to provide lower stiffness in the direction of actuation (parallel to the plane of the base layer).

Figure 2:
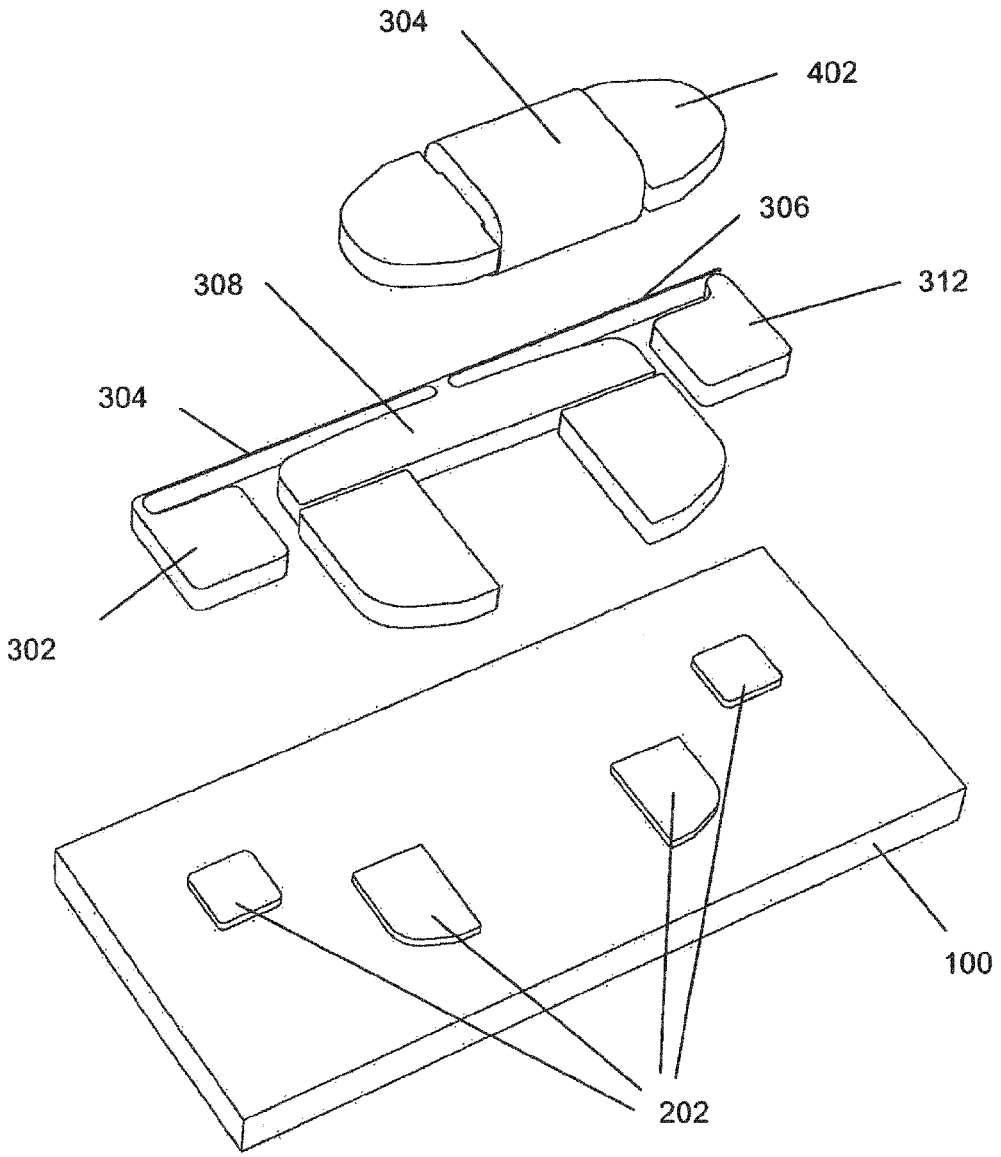
FIG. 2 is an exploded view of the top two layers of an example embodiment of an SPST switch.

FIG. 2 is an exploded view of an embodiment like that described in connection with FIG. 1. In FIG. 2, a spacing layer 202 is disposed between the base layer 100 and the moveable member layer. The spacing layer 202 provides a mechanical gap between the substrate or base layer 100 and the moveable member layer. The spacing layer material can be either electrically insulating or electrically conductive depending on the type of packaging used and the method of providing a conductive path from the electrical pads 302, 312 to external connections.

Figure 3:
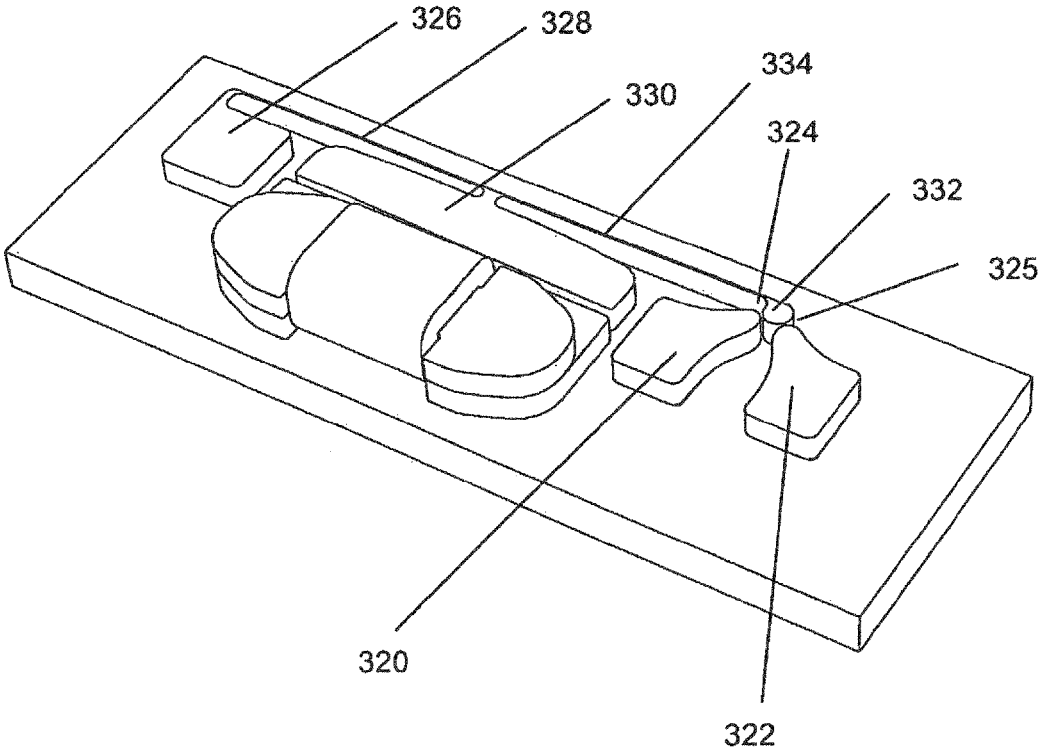
FIG. 3 is an illustration of an example embodiment of an SPST switch.

The example embodiment of FIG. 1 can accommodate various other arrangements of electrical pads. FIG. 3 is an illustration of an example embodiment using a similar electromechanical arrangement as the example of FIG. 1 but with a different electrical arrangement. Two electrical contact pads 320 and 322 mount with the base layer near a tip 332 of an electrical contact spring 334. The tip 332 can be separated from the contact pads 320, 322 by gaps 324, 325. An anchor pad 326 supports the moveable member 330 and a spring 328. When the switch is closed, an electrically conductive path is provided from one contact pad 320 through the tip 332 to the other contact pad 322.

Figure 4:
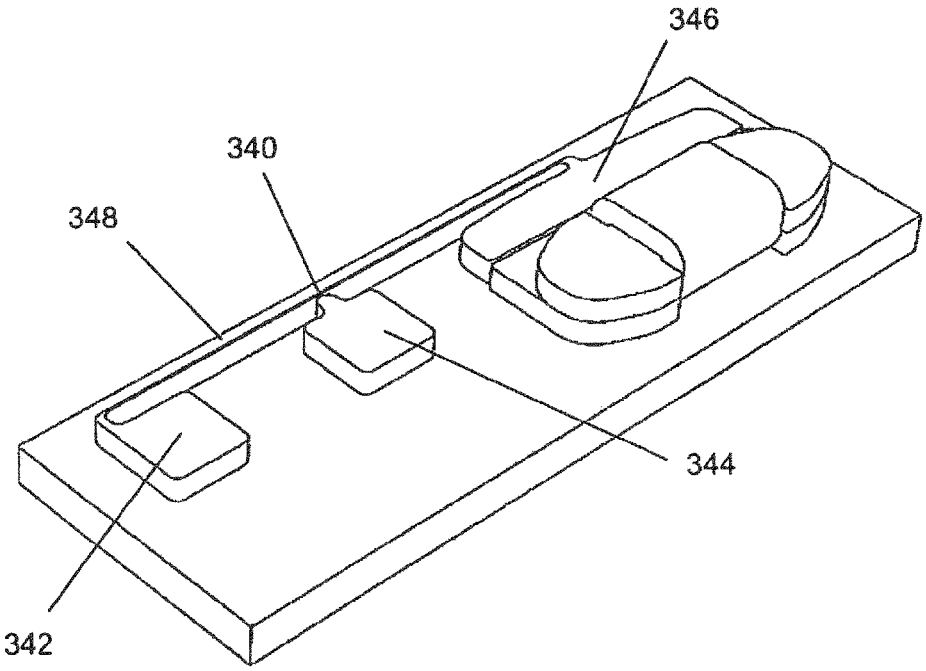
FIG. 4 is an illustration of an example embodiment of an SPST switch.

FIG. 4 is an illustration of another example embodiment using a similar electromechanical arrangement as the example of FIG. 1 but with a different electrical arrangement. An electrical contact 340 is disposed between a first contact pad 342 and the armature 346. Closure of the switch forms an electrical path from the first contact pad 342 to a second contact pad through a cantilevered support spring 348.

Figure 5:
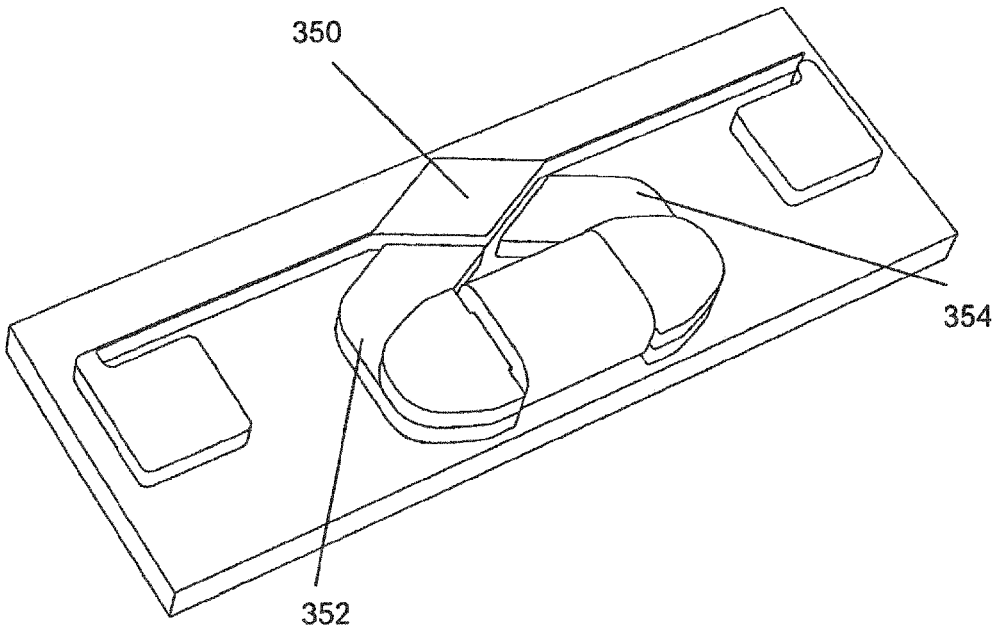
FIG. 5 is an illustration of an example embodiment of an SPST switch.

FIG. 5 is an illustration of another example embodiment. The arrangement of the elements is similar to that described in connection with FIG. 1. The armature 350 and magnetic poles 352, 354 in the example of FIG. 5 are shaped differently than those of the example of FIG. 1. Tailoring the geometry of the magnetic path can allow operational characteristics such as the relationship between force and armature displacement to be adjusted, e.g., to beneficially match a desired current drive or electrical contact force adjustment.

Figure 6:
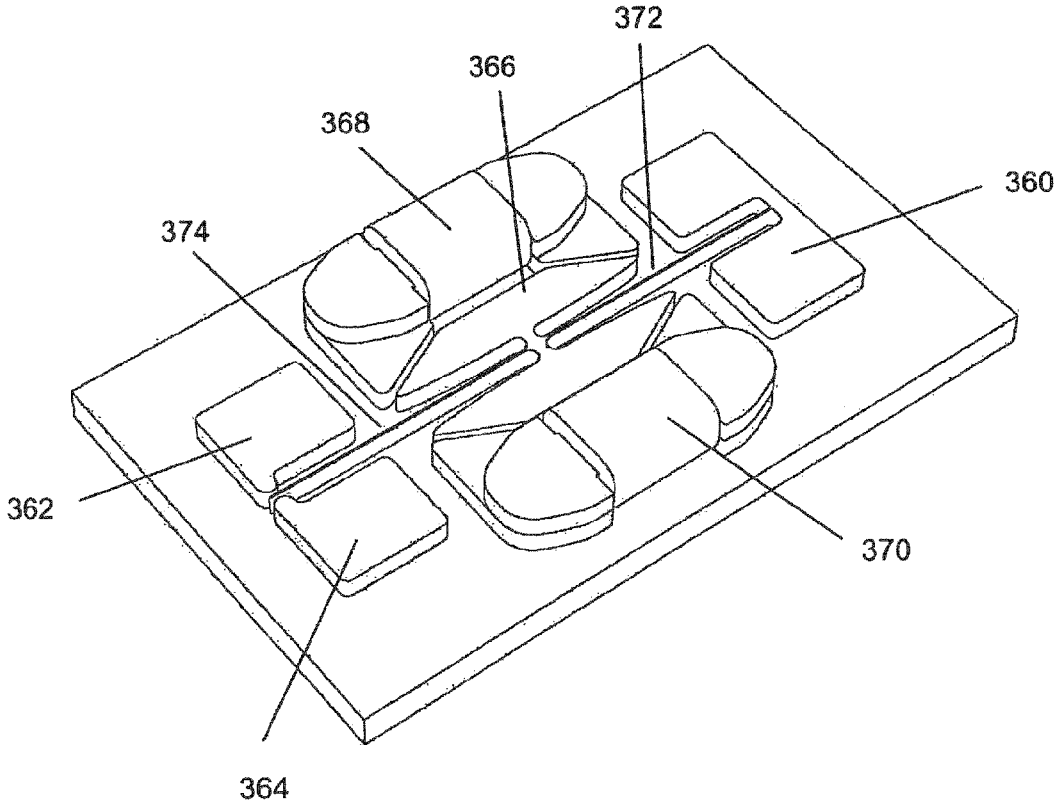
FIG. 6 is an illustration of an example embodiment of a three contact switch.

FIG. 6 is an illustration of another example embodiment. The example of FIG. 6 has first 360, second 362, and third 364 contact pads disposed in a second layer substantially parallel to a base layer. Energizing a first coil 368 urges an armature 366 to move substantially parallel to the base layer such that a contact spring 374, mounted with or formed as part of the armature 366, contacts the second contact pad 362, forming an electrical circuit between the first 360 and second 362 contact pads. Energizing a second coil 370 urges the armature 366 to move substantially parallel to the base layer such that the contact spring 374, mounted with or formed as part of the armature 366, contacts the third contact pad 364, forming an electrical circuit between the first 360 and third 364 contact pads.

Figure 7:
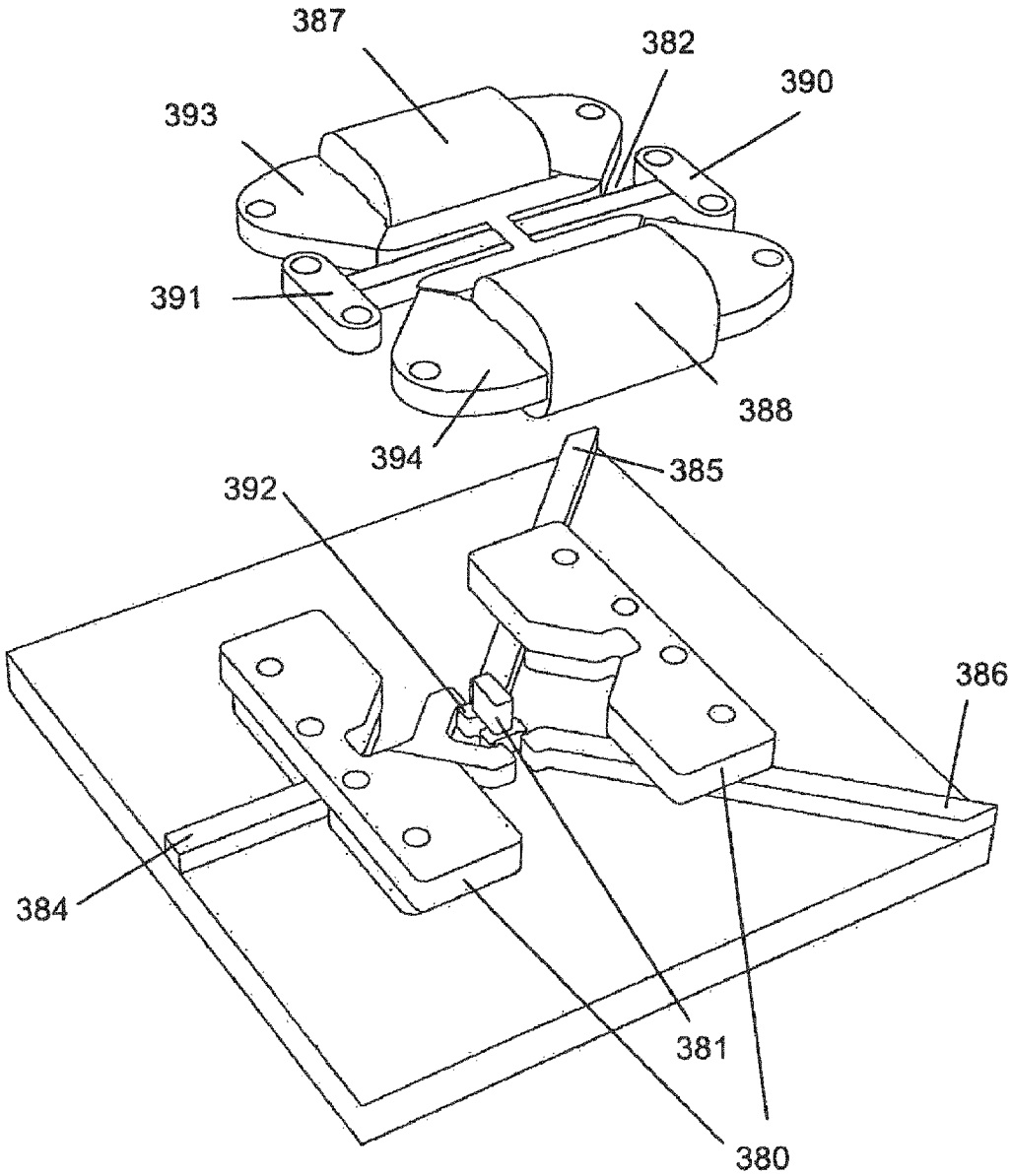
FIG. 7 is an exploded view of an example embodiment of a three contact switch with the top layer separated from the bottom three layers.
Figure 8:
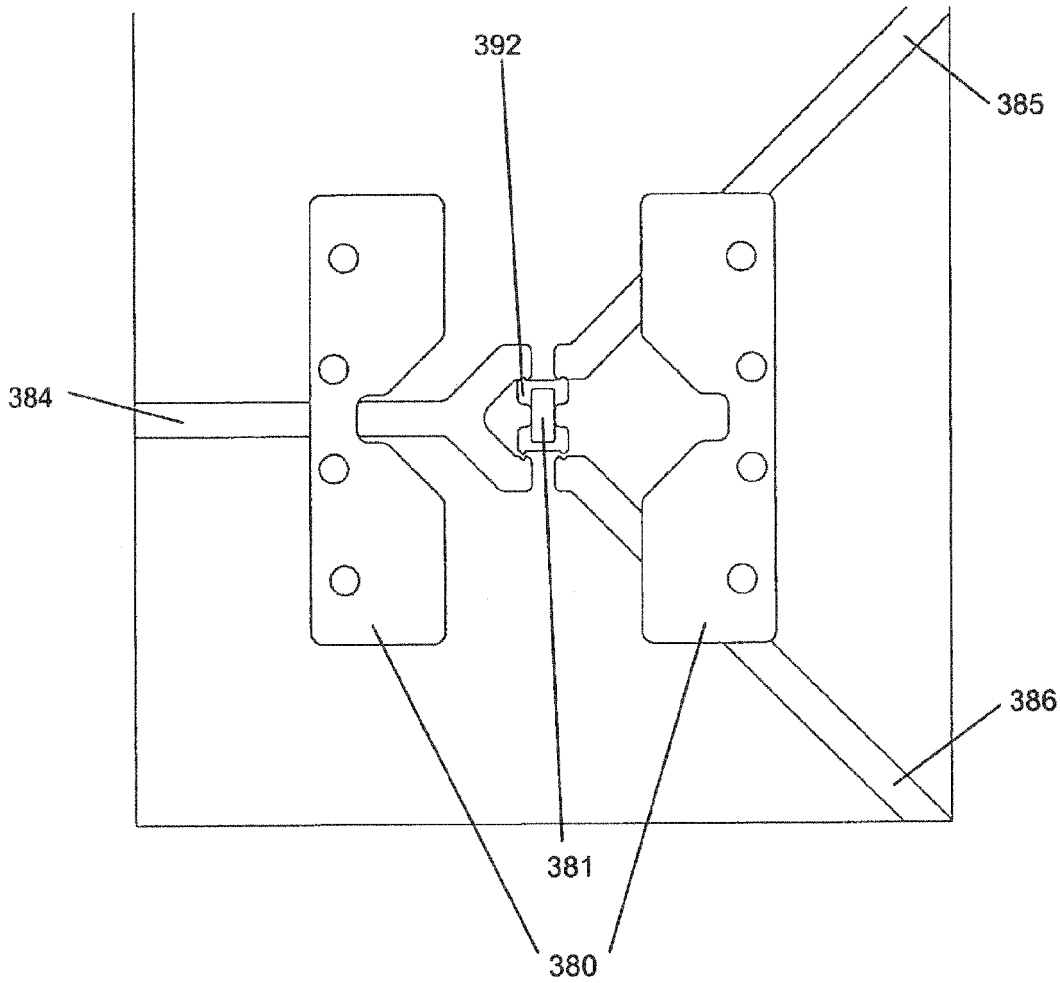
FIG. 8 is an illustration of electrical paths in an example embodiment of a three contact switch.
Figure 9:
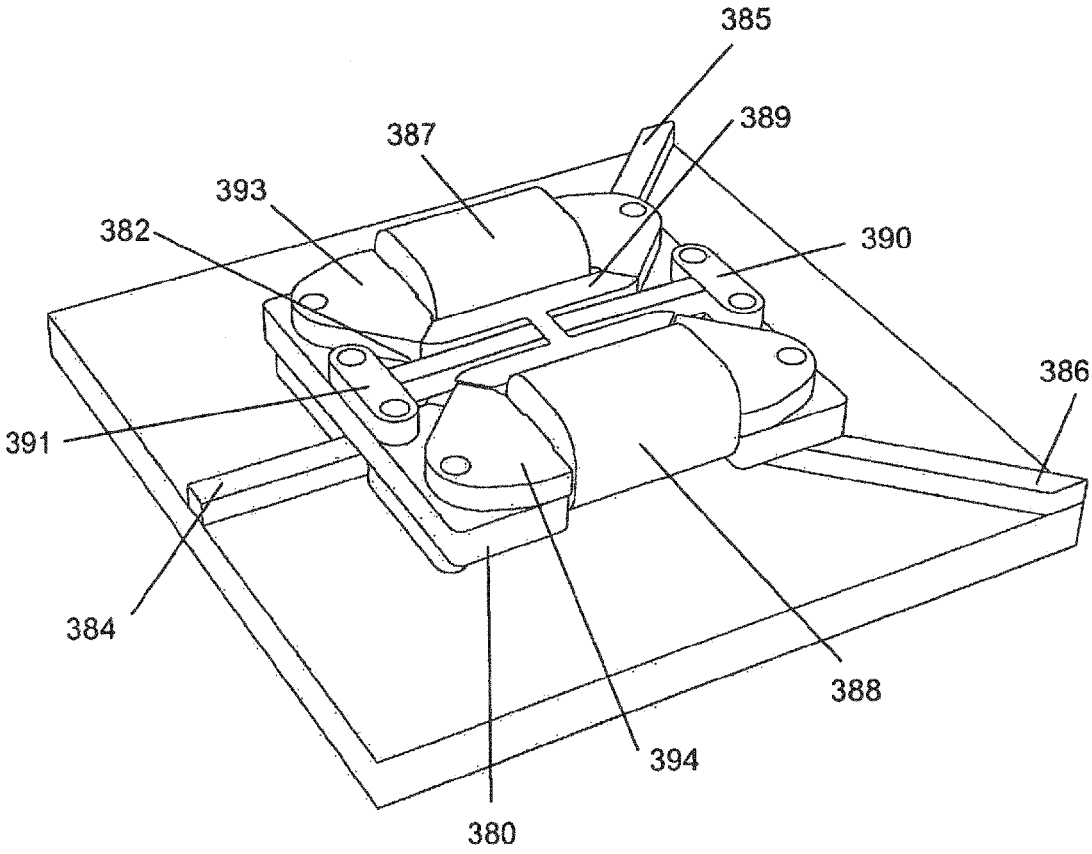
FIG. 9 is an illustration of an example embodiment of a three contact switch.

FIGS. 7, 8, and 9 are views of an extended topology of a switch like those described before. The switch can be described as comprising a plurality of substantially parallel layers: a base layer, an electrical layer, an insulating layer, and a moveable member layer. Those skilled in the art will appreciate combinations of layers or disposition of elements into different or additional layers. The electrically insulating layer 380, comprising for example glass, ceramic or plastic material, can isolate the electrical paths and contacts in the electrical layer from the magnetic paths in the moveable member layer. The switch also comprises a bistable spring 382 which can maintain electrical contact in one state without requiring continuous application of current. The switch thus provides a latching single pole double toggle switch (SPDT) which can maintain electrical contact between two electrical paths without the continuous application of current to electromagnets 387, 388. Energizing (e.g., by applying a current to) a first coil 387 urges an armature 389 to move the bistable spring 382 and a contactor 392 such that the contactor 392 electrically connects the electrical paths 384 and 385. Energizing (e.g., by applying a current to) a second coil 388 urges the armature 389 to move the bistable spring 382 and a contactor 392 such that the contactor 392 electrically connects the electrical paths 384 and 386. The contactor 392 can be mechanically coupled to the armature 389 and the bistable spring 382 with an insulator 381. Anchors 390, 391 of the bistable spring 382 can be mounted directly on the insulating layer. The electrical paths, including the contactor 392, are thus electrically isolated from the armature 389, discouraging coupling of the electrical paths 384, 385, 386 to the armature 389, attached supporting spring 382, attached anchors 390, 391 and magnetic cores 393, 394.

Figure 10:
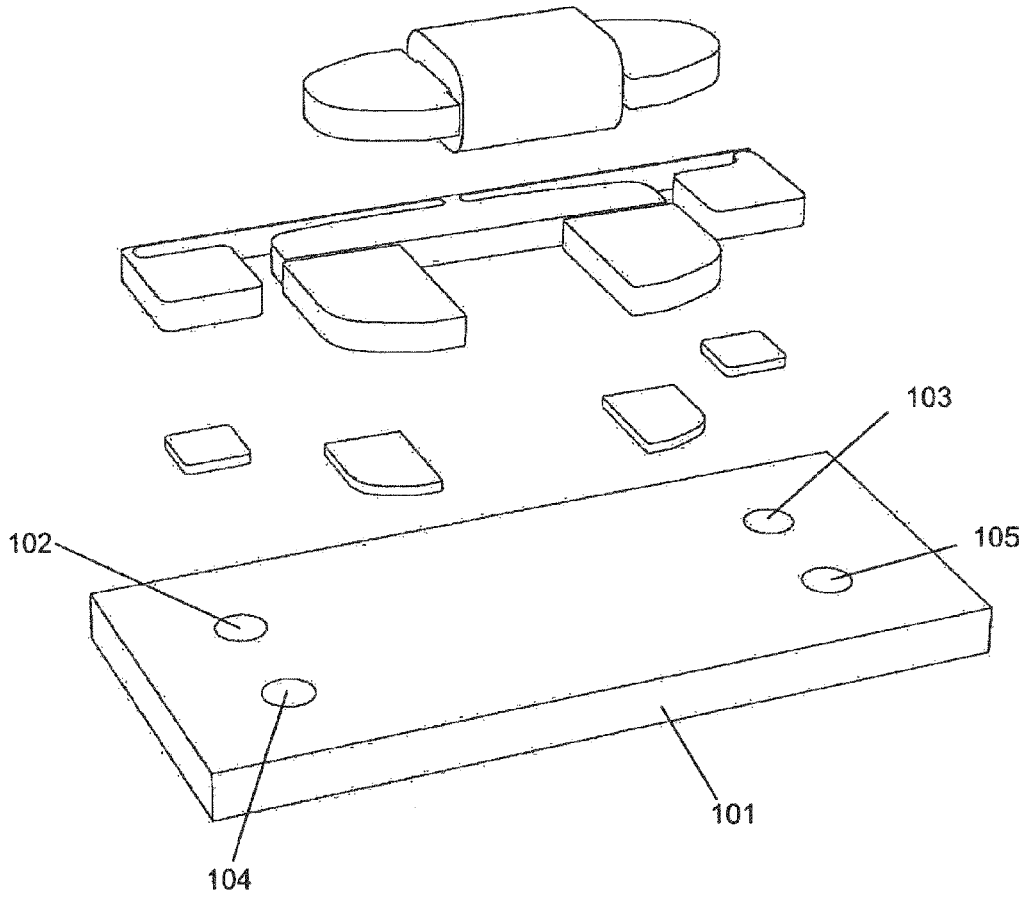
FIG. 10 is an exploded view of an example embodiment of a basic SPST switch showing vias in the lower substrate layer.
Figure 11:
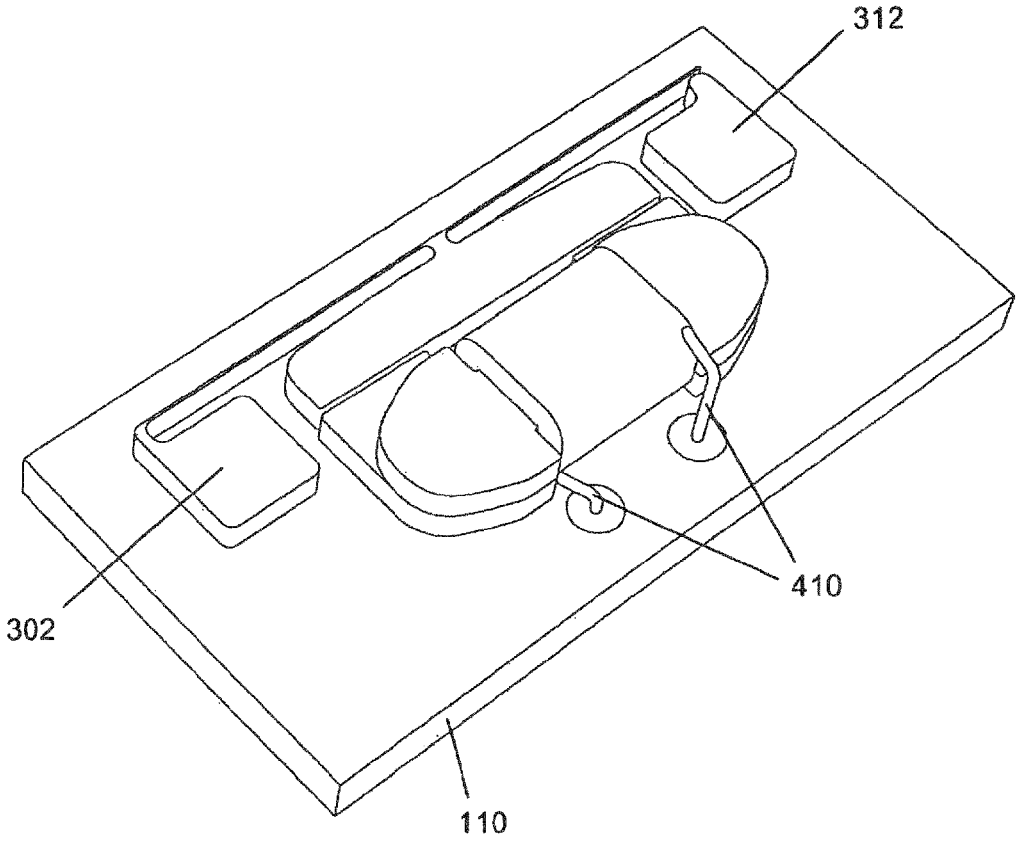
FIG. 11 is an illustration of one embodiment of a basic SPST switch showing electrical connection of an electromagnetic coil to vias in the lower substrate layer.

FIG. 10 is an exploded view of an example embodiment with electrical vies provided for external electrical connection. The switch in the figure reflects one of the examples described previously; the external electrical connections can be used with many embodiments. Electrical vias comprising paths of good electrically conducting material 102, 103, 104, 105 extend through an electrically insulating substrate 101. The vias provide electrical connection to the switch contacts 302, 312 and electromagnetic coil wire 410 as shown on the substrate 110 in FIG. 11.

Figure 12:
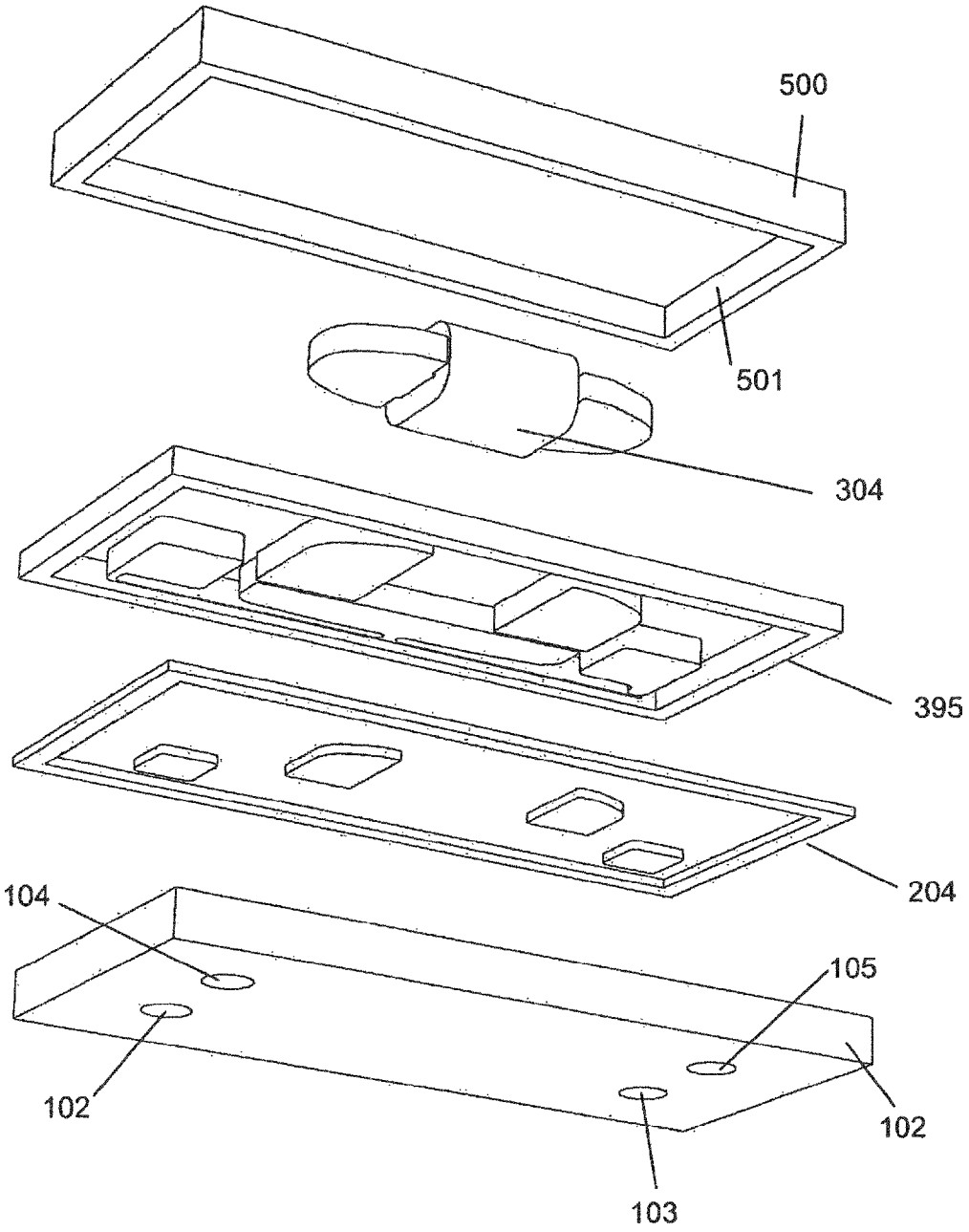
FIG. 12 is an exploded view from the bottom of one embodiment of a packaged basic SPST switch showing the addition of a top cover layer and border features in the second and third layers.
Figure 13:
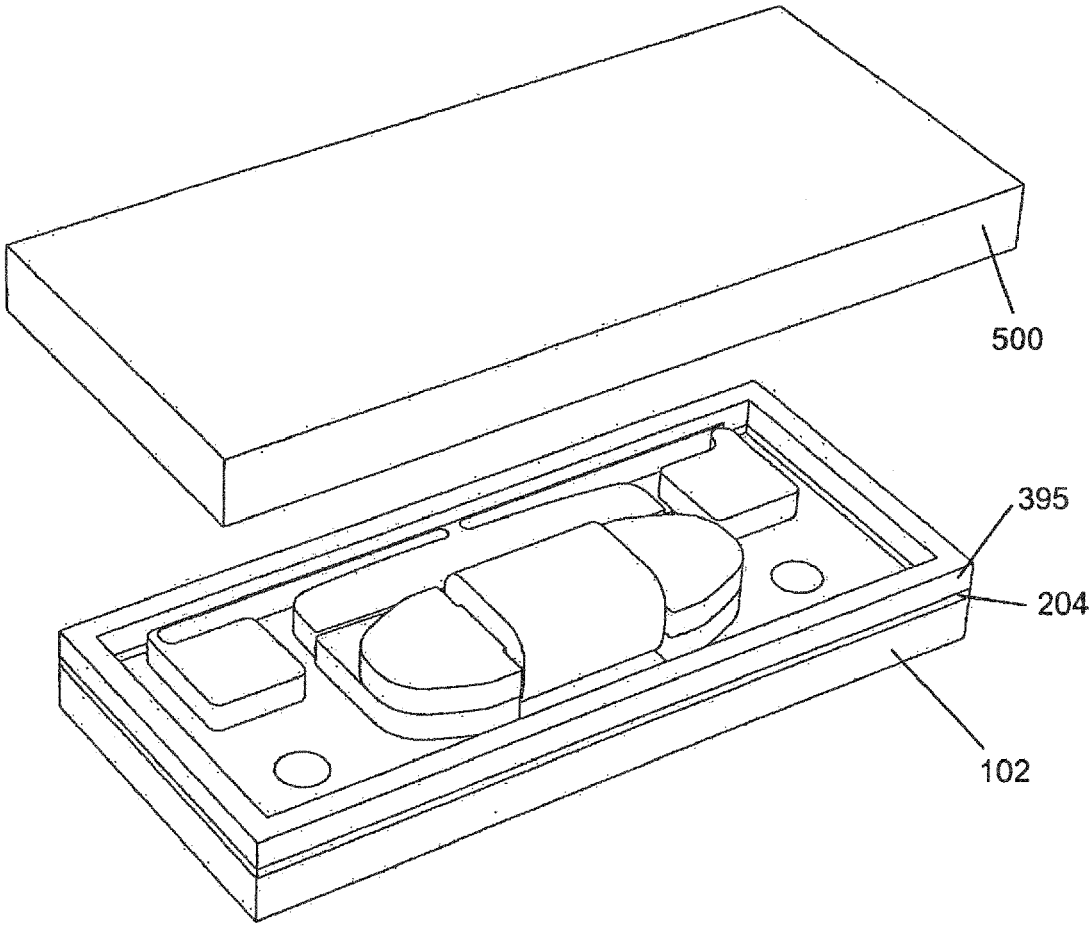
FIG. 13 is an exploded view from the top of one embodiment of a packaged basic SPST switch with the top cover layer separated from the lower 4 layers.
Figure 14:
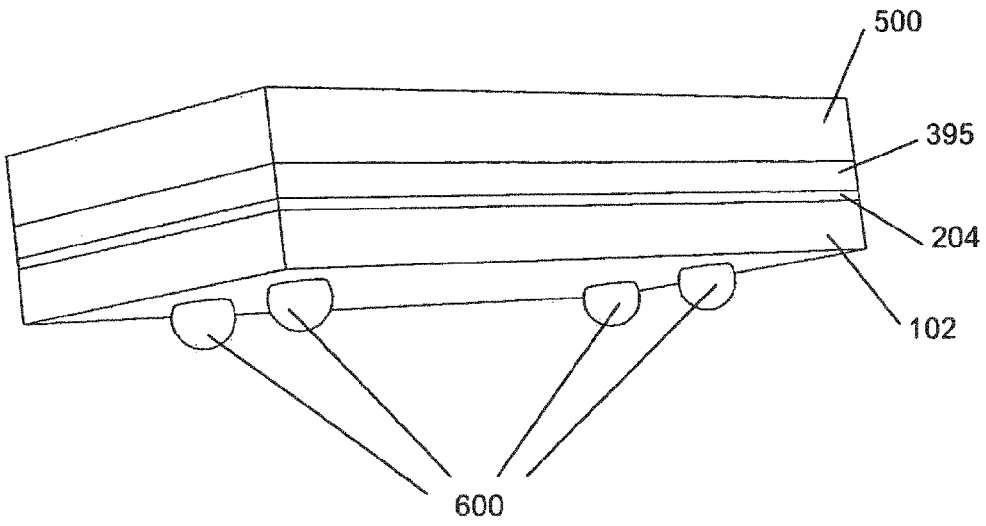
FIG. 14 is a bottom view of a packaged basic SPST switch showing the addition of solder bumps for electrical connection.

FIG. 12 is an exploded view of a switch like those described before, integrated with a covering to protect the switch mechanism from external environments. Borders 204, 395 and a cover 500 mount with the base layer 102 to provide a protective environment for the switch elements such as the coil 304. Arrangement of the borders and cover in layers, similar to the switch element layers, makes the entire assembly suitable for wafer scale packaging. The cover 500 in this example embodiment comprises a lip 501 which provides additional clearance of the cover over the coil 304. FIG. 13 is another illustration of the example, with the borders 204, 395 attached to the substrate or base layer prior to attachment of the cover 500. In FIG. 14, solder bumps 600 have been added to the external side of the base layer to provide for convenient external electrical connection to the switch elements, for example by mounting on a conventional printed circuit board.

Figure 15:
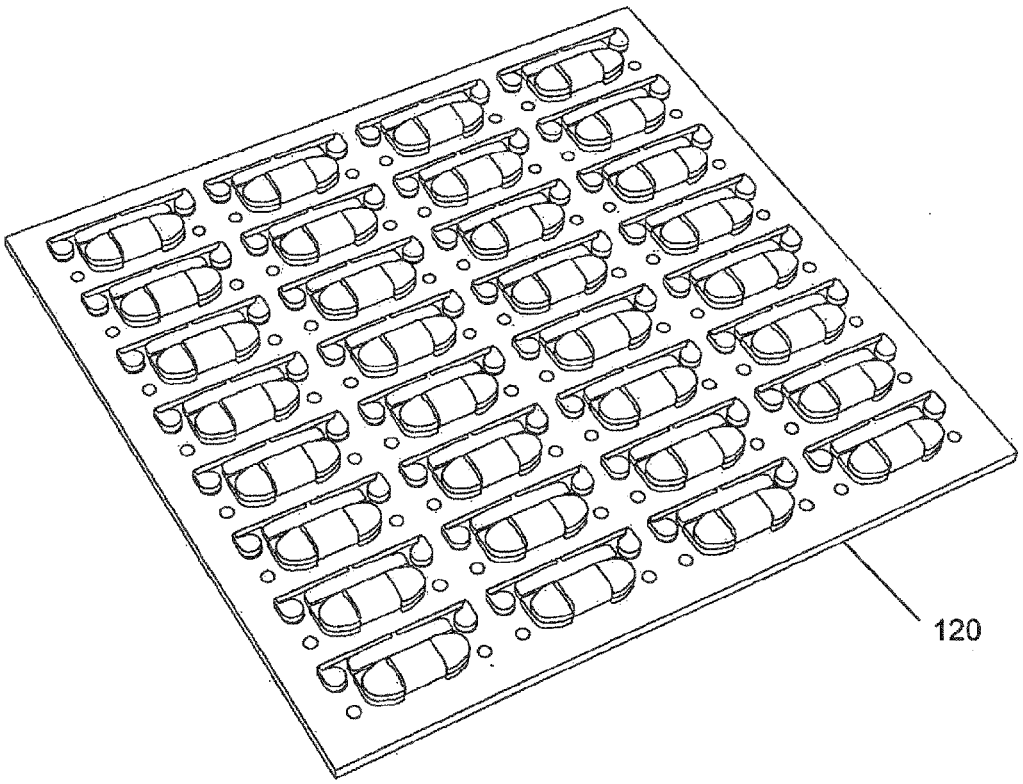
FIG. 15 is a view of one embodiment of a 4×8 array of SPST switches residing on a common substrate.
Figure 16:
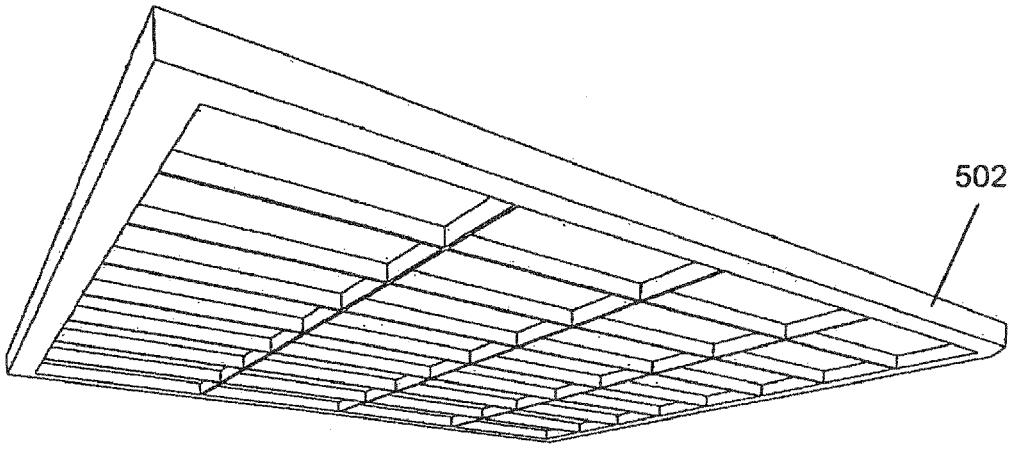
FIG. 16 is an exploded view of a 4×8 array of SPST switches with the top cover removed from the lower 4 array layers.
Figure 16:
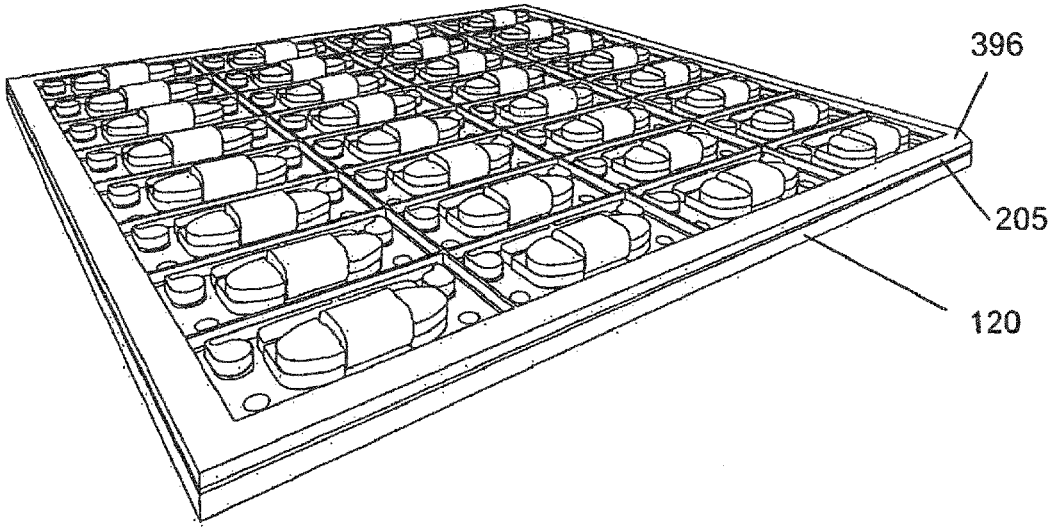
Figure 17:
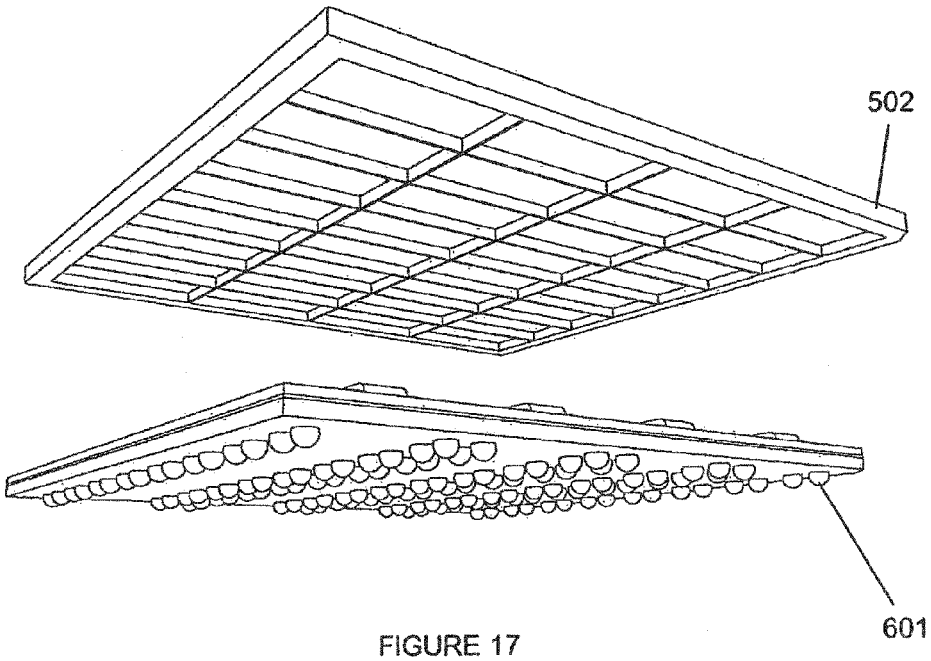
FIG. 17 is an exploded view from the bottom of a 4×8 array of SPST switches showing solder bump connection extending from the lower layer.
Figure 18:
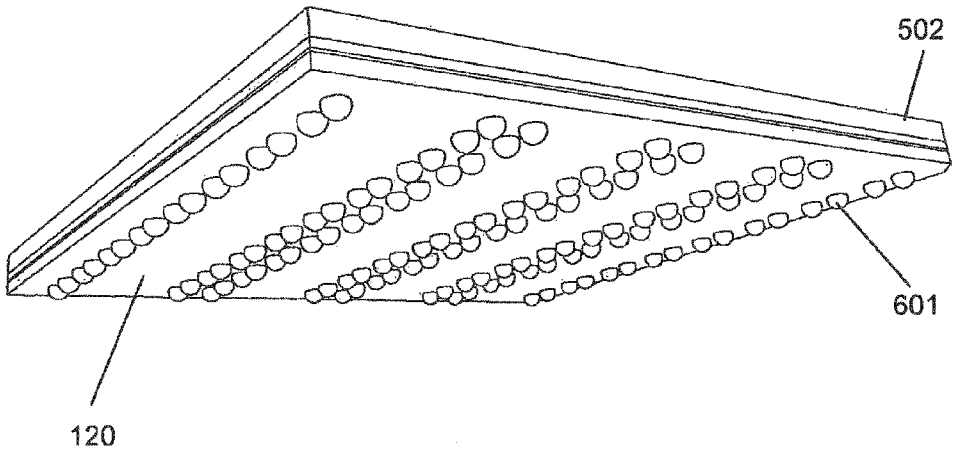
FIG. 18 is a view from the bottom of one embodiment of a packaged 4×8 SPST switch array.

FIG. 15 is an illustration of a substrate or base layer 120 with multiple switches mounted thereon. The layered structure of the switches can allow simultaneous fabrication of the relays on the substrate. FIG. 16 is an illustration of a multiple switch substrate 120 with borders 205, 396 and corresponding cover 502 suitable for protecting the switches. FIGS. 17 and 18 are illustrations of a multiple switch substrate, packaged with borders and cover, and with solder bumps disposed on the external side of the base layer to provide for convenient external electrical connection to the switch elements, for example by mounting on a conventional printed circuit board.

Example Switch Embodiment

FIGS. 35(*a-h*) are schematic illustrations of an example embodiment of the present invention. The example embodiment comprises a SPDT (single-pole double throw) switch, and comprises a bi-stable mechanical spring with a pair of variable reluctance magnetic actuators. The two magnetic actuators act to switch a common RF port to two stable states after which a DC control power is not required to maintain contact. Each stable state results in a high contact force between the common RF port and the output ports.

The example SPDT topology comprises of 4 layers and is depicted in FIGS. 35(*a,b*). Typical dimensions for the device are: switch length=3.5 mm (spring anchor–spring anchor), width=3.2 mm (outer coil edge–outer coil edge), height=0.9 mm (top of substrate to top of coil). The four layers, from the bottom up, are: 501, substrate layer; 502, RF layer; 503, isolation layer; and 504, electro-magnetic actuation layer. FIG. 35(*a*) depicts all four layers, while FIG. 35(*b*) provides an exploded view of the upper three layers, all of which can be micro-fabricated. Also shown in the figures are plastic (PMMA) assembly pins that can be press fit into the components during assembly. Alternatively, the layers can be bonded together without the use of press fit pins.

The substrate layer, approximately 0.5 mm thick, can comprise commercial glass, and forms the bottom layer of what will become the package. The RF layer in the example comprises a deep x-ray lithography-defined copper layer of approximately 250 micrometer thickness and includes signal lines, a ground plane, RF contacts, wiring for electromagnetic coils, and a perimeter for the sealed package cover. A bottom view of this layer, with substrate and electromagnetic actuation layers removed, is shown in FIG. 35(*c*). The locations of the plastic pins that affix this layer to the next are shown. The two output paths (Ports 1 and 2) are widely separated to provide isolation and both the input and output lines are 300-500 microns wide to minimize transmission-line losses. The dimensions of the CPW lines have been chosen to result in a 50 O t-line. Low loss is further enhanced by both the inherently smooth surface (15 nm roughness) of the copper layer which is provided by the micro-fabrication process, as well as by a gold coating to reduce oxidization and provide enhanced contact performance. The copper can be first sputtered with TiW to insure good adhesion, and then sputtered with gold. An additional layer of gold can be optionally plated over the sputtered layers.

Although this example embodiment of the switch is a CPW (co-planar waveguide) design, in another embodiment it uses microstrip transmission lines. Virtually nothing changes in the design of the microstrip embodiment, except the removal of the CPW ground. In this second embodiment, an RF ground can be electroplated on the bottom of the substrate layer (e.g., glass wafer, layer 1). The remainder of this description focuses on the CPW embodiment.

The dielectric isolation layer, approximately 100 to 250 micrometers thick, is fabricated in this example embodiment from deep x-ray lithography-patterned PMMA (plexiglass) due to the relative ease with which it can be implemented. Glass can also be used for the isolation layer. The isolation layer isolates the RF circuit from the magnetic circuit by providing a large dielectric spacer, and can be easily seen in the exploded view of FIG. 35(*b*). The PMMA layer has reasonably low dielectric loss at 0.1-6 GHz and does not increase the loss of the CPW lines.

The electro-magnetic actuation layer is shown in FIGS. 35(*d,e*). FIG. 35(*d*) shows a top view of the electro-magnetic actuation layer alone, while FIG. 35(*e*) shows the geometric relationship between the features in the electro-magnetic actuation layer and the RF layer. An important aspect of the example switch which both generates the high contact forces and creates the bi-stability of the switch is the double beam bi-stable flexure shown in FIG. 35(*d*).

The electromagnetic actuation layer is approximately 250 micrometers thick, and comprises a deep x-ray lithography patterned and electroformed nickel/iron alloy material, e.g. 78 Permalloy, which provides a soft ferromagnetic path to isolate magnetic flux and is also an excellent spring material. Two electromagnetic coils provide the driving magnetic field, and together with their pole faces and respective plungers attached to the spring comprise two separate magnetic circuits. A magnetic flux density of approximately 0.7 Tesla (78 Permalloy saturates at 1.0 Tesla) can be maintained in the working air gap which yields an equivalent pressure of about 30 PSI. Operation into two working gaps of approximately 30×250 micrometer yields a plunger force of several milliNewtons. This force can be further enhanced by using multiple poles.

The example embodiment can be assembled with a series of press fit steps. The castellated press fit interface between the coil mandrels and the rest of the two stationary magnetic circuits is also shown in FIG. 35(*d*). By energizing one coil or the other, the holding force of the spring is overcome and the device switches states. Once in the new switched position, the force of the springs maintains the contact until the time to switch back, which occurs when the opposite coil is momentarily energized.

The RF layer contacts, which are attached to the moving pole piece through the PMMA pins and the isolation layer, are thereby switched between the two RF paths. Because all structures and press fit pins can be lithographically patterned with deep x-ray lithography, 0.25 micron precision is readily achieved and all relative alignments are correspondingly accurate. This also helps insure good switch performance both by the precise positioning of the plunger relative to the air gaps, as well as by the proper positioning of the moving contact relative to the fixed contacts.

Example Safing Device Embodiments

Safing device embodiments according to the present invention can provide a fully integrated micro-miniature device and method for initiating the ignition process form rocket motor, warhead, explosive separation device or other similar device that relies on energetic materials while simultaneously providing a mechanism for mechanically sating the device. In one embodiment the device operates as a safe and arm device, while in another it operates as an arm/fire device. There are also several embodiments of a micro-fabricated initiation device integral to the ignition device.

Figure 19:
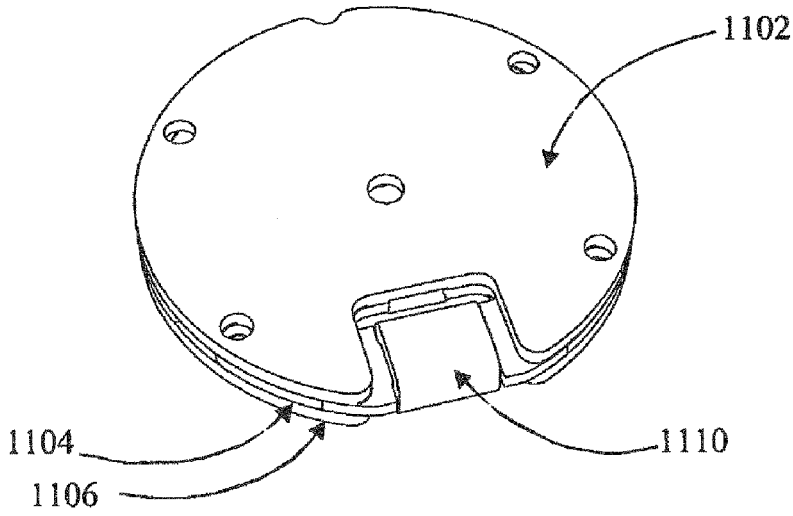
FIG. 19 is a view of the upper three layers (of four in total) of one embodiment of a micro-miniaturized safing device.
Figure 20:
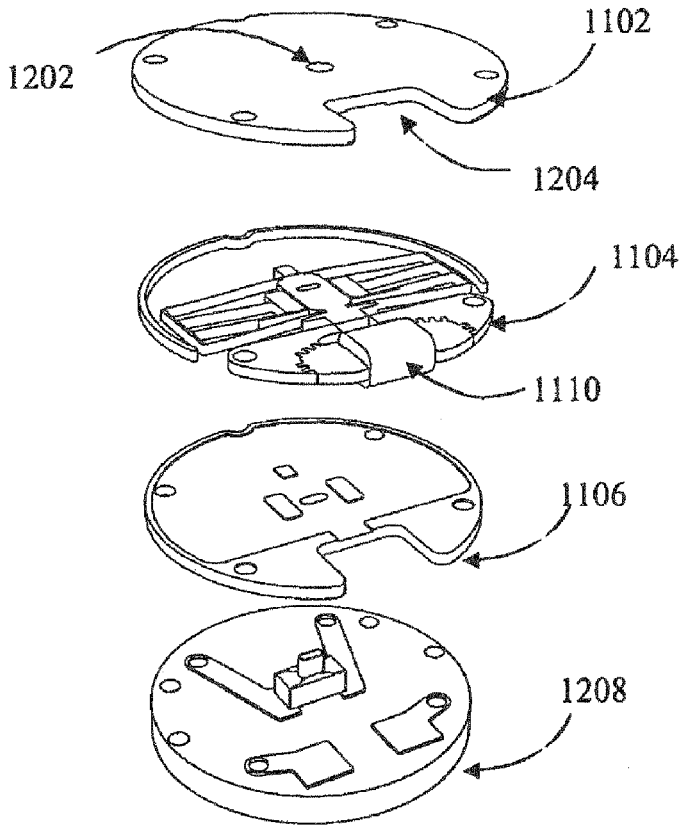
FIG. 20 is an exploded view of an example embodiment of a micro-miniaturized safing device.

In an example embodiment, an ignition device comprises four micro-fabricated layers. The upper three are shown in FIG. 19; all four are shown in FIG. 20. These layers comprise: a first or "upper housing" layer (1102) providing a portion of the housing for the shutter mechanism and a mounting interface for a secondary or high explosive or for other mechanical interface; a second or "shutter" layer (1104) incorporating the physical safing mechanism that provides for interruption of the ignition train; a third or "lower housing" layer (1106) that protects and houses the shutter mechanism from below and also provides an interface into the fourth, or "initiator" layer (1208) that contains the initiating pyrotechnic as well as the electrical interfaces to the device. An electric coil (1110) is an integral part of the shutter layer and is wound around a mandrel contained within that layer but extends into cut-outs in the upper and lower housing layers.

FIG. 20 is an exploded view of the ignition device showing all four micro-fabricated layers in more detail. The first layer incorporates a central aperture (1202) which provides access to the secondary or high energy explosive that follows the ignition device in the overall ignition chain. The first layer incorporates a cut-out (1204) to accommodate the coil (1110).

Figure 21:
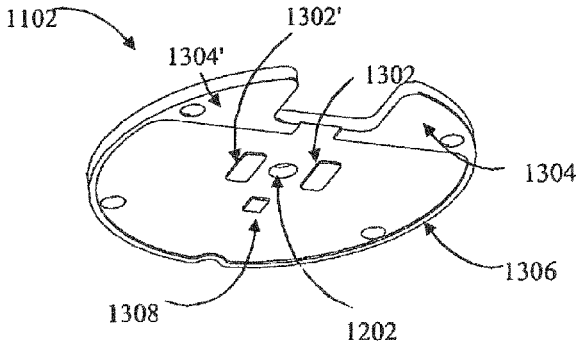
FIG. 21 is a detailed view of the bottom surface of the upper housing layer.

FIG. 21 is a view of the lower surface of the first layer and shows bond pads that provide mounting points for the shutter/flexure and damping means (1302, 1302), the magnetic circuit elements (1304, 1304'), the spacer ring (1306), and the shutter stop (1308) all of which are contained within the shutter layer. These bond pads also space the shutter/flexure and damping mechanisms away from the lower surface of the first layer so that neither the shutter nor the damping means are directly in contact with the first layer. The first layer can be fabricated from Permalloy, a Ni—Fe alloy.

Figure 22:
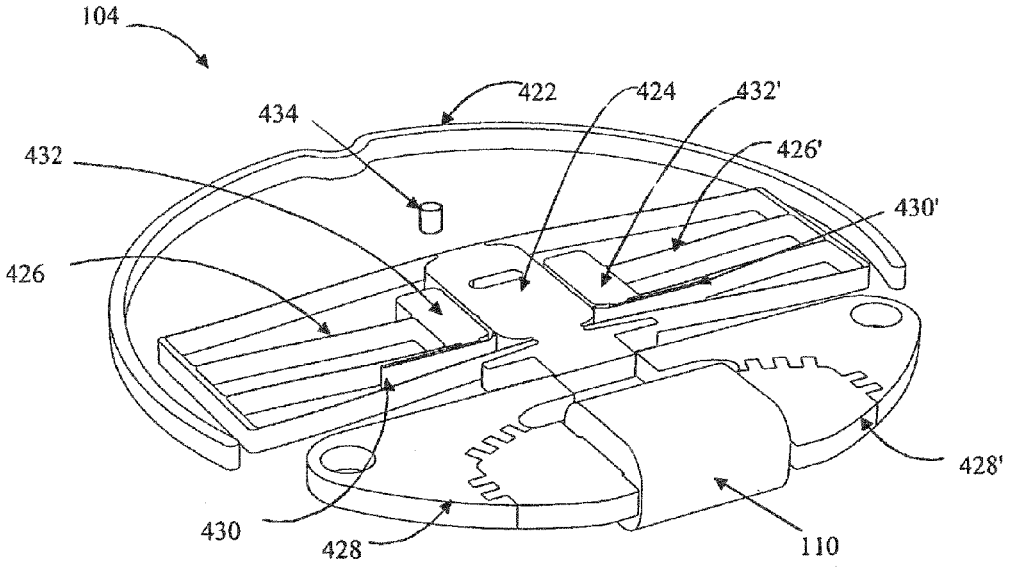
FIG. 22 is a detailed view of the shutter layer with the shutter in the "safe" mode.
Figure 23:
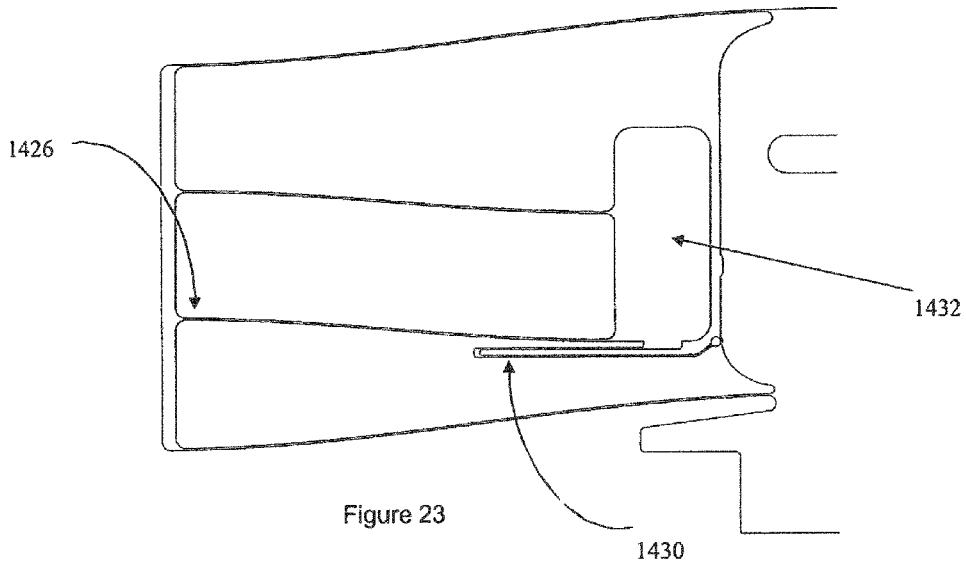
FIG. 23 is a detailed view of the flexure and damping structure of the shutter layer.

The second layer, as shown in isolation in FIG. 22, incorporates a spacer ring (1422), the shutter (1424) and integral flexure structure (1426, 1426'), the shutter damping stop (1434), a magnetic circuit component consisting of a wound coil (1110) with a core that extends beyond the coil (1428, 1428') and a damping means. In an example embodiment the damping means consists of two opposing springs (1430, 1430') that attach to the base of the flexure, contact the shutter from opposite sides, and eliminate any tendency of the flexure structure to vibrate or otherwise execute unwanted lateral motion. The flexure mounting points (1432, 1432') are, during assembly, bonded to the bond pads (1302, 1302') contained within the first layer, and thus neither the shutter nor the damping means is in contact with the first layer but is separated by the thickness of the bond pads. The design of the flexure mechanism is such that the shutter can move freely in the lateral directions as required to cover and to expose the aperture through which the pyrotechnic energy is transferred, but is constrained with respect to motion in the vertical direction so that it does not rub or otherwise contact the first or third layers of the assembly. The flexure is a bi-stable design, for example a doubly folded design. This is clearly shown in FIG. 23 which is a detail illustration of the flexure (1426) and damping spring (1430) and their relationship to the flexure mounting point (1432).

Figure 24A:
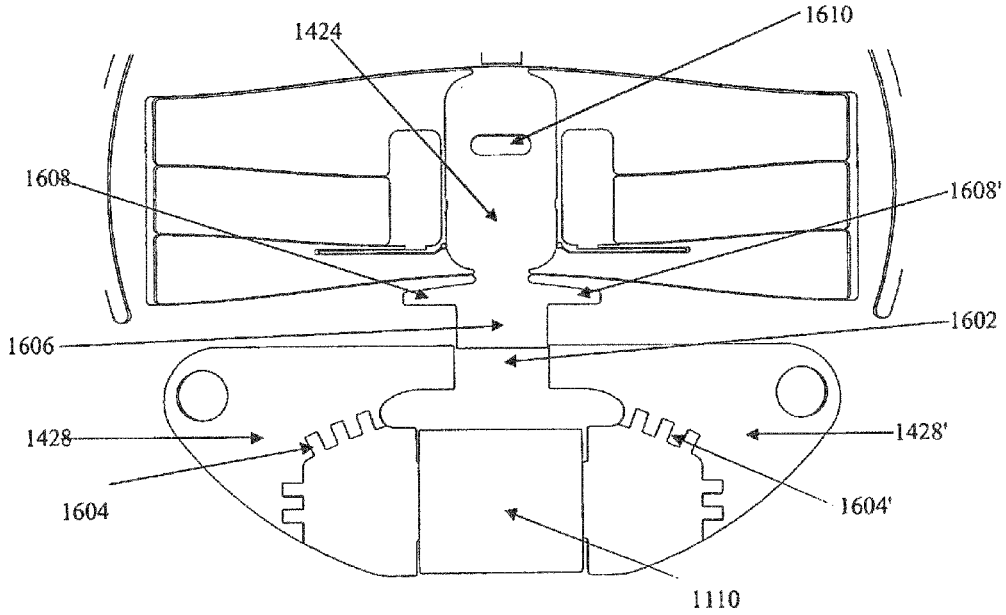
FIG. 24(*a*) is a detailed view of the magnetic circuit elements of the shutter layer with the shutter in "safe" mode.
Figure 24B:
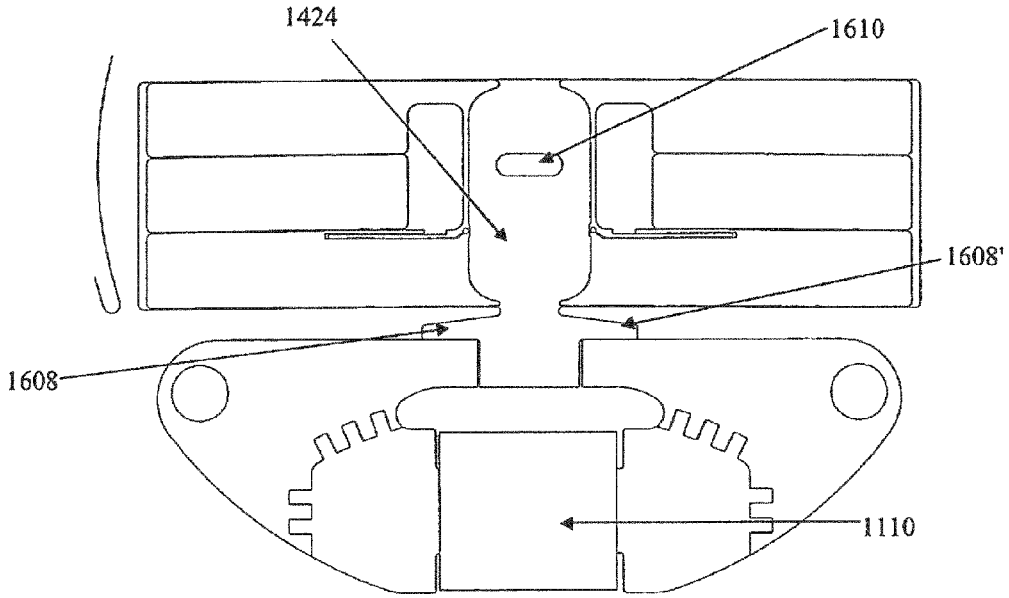

Shown in detail FIG. 24(*a*), the magnetic circuit element comprises an electrical coil (1110) wound around a ferromagnetic core that extends beyond the coil material (1428, 1428') with a gap (1602) into which a portion of the shutter (1606) may move freely and without physical contact between the shutter and the ferromagnetic core. The shutter (1424) and its constituent elements (1606, 1608, 1608') are also fabricated of a ferromagnetic material. In one embodiment permalloy is used for the shutter and flexure as well as the core. This provides for strength, flexibility, ferromagnetic properties, and ease of microfabrication. Features (1604, 1604') show the bond line between two independently microfabricated elements of the shutter layer.

FIG. 24(*a*) shows the shutter in safe mode, with the magnetic circuit not energized and the shutter not drawn into the gap (1602) in the magnetic circuit. In this position the shutter aperture (1610) is not aligned with either the aperture (1202) in the upper housing layer or the aperture (FIG. 25, item 710) in the lower housing layer. Thus the passage of energetic material from the initiator to the secondary or high explosive is blocked. FIG. 24(*b*) shows the shutter in armed mode with the shutter drawn into the gap and the shutter stops, (1608, 1608') up against a portion of the core of the coil that extends beyond the coil and forms the gap (1602). In this position, the shutter aperture (1610) is aligned with both the apertures in the upper and lower housing layers (1202) and (1710) respectively so that energetic material may be transferred from the initiator to the secondary of high explosive.

Figure 25:
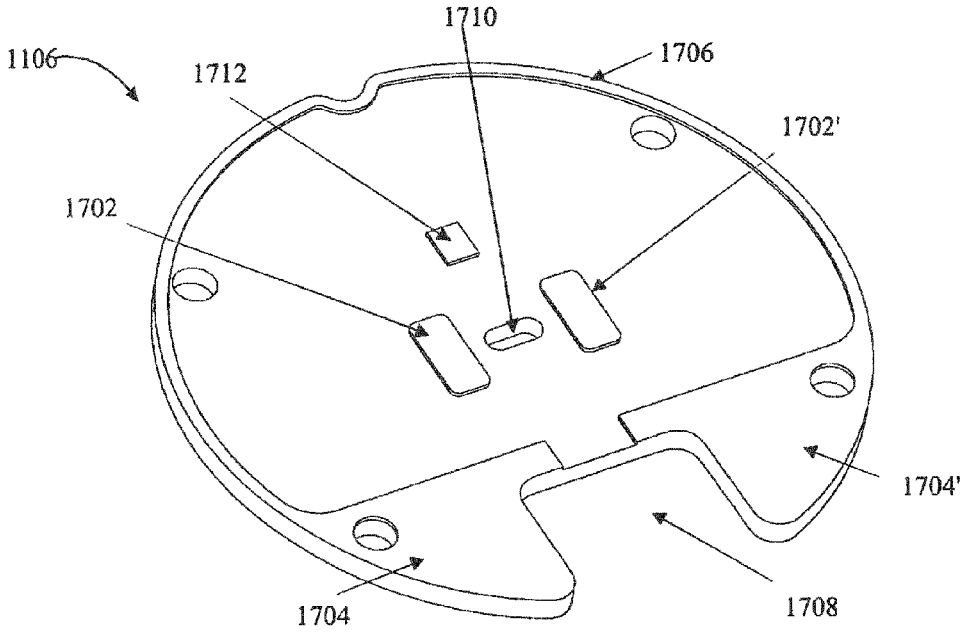
FIG. 25 is a detailed view of the upper surface of the lower housing layer.

An isolated top view of the third layer (1106) is presented in FIG. 25. The third layer incorporates bond pads for the shutter/flexure component and damping means (1702, 1702'), the shutter stop (1712), the magnetic circuit elements (1704, 1704'), and the spacer ring (1706). These bond pads are identical in shape and functionality to those in the first layer. There is similarly a cutout (1708) in third layer to accommodate the coil. The aperture in the central portion of the third layer (1710) is smaller than the corresponding aperture in the first layer.

Figure 26:
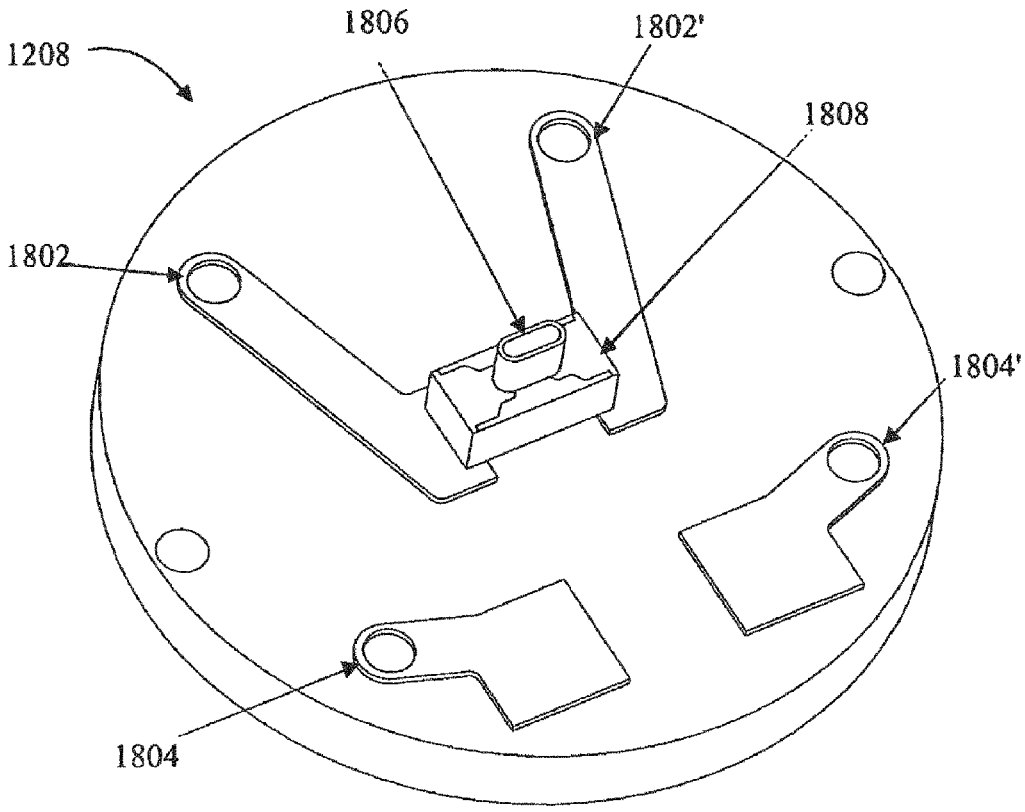
FIG. 26 is a view of the upper surface of the initiator layer.

An isolated view of the fourth layer (1268) is presented in FIG. 26. This layer contains electrical bond pads (1904, 1804') for the coil that drives the magnetic circuit, bond pads (1802, 1802') for the electrical interface to the initiator, and the initiator itself consisting of charge sleeve (806) and butterfly bridge wire chip (1808).

In another embodiment, the initiator employs a microfabricated bridge wire integral to the charge sleeve. In yet another embodiment the flexure design is such that once the shutter has been moved into the armed mode, the spring forces continue to keep the shutter in the armed mode even if power is removed from the coil rather than return the shutter to the safe mode. This provides a latching mode of operation and is useful for an arm/fire device.

Operation. In use, energetic material is placed in the charge sleeve (1806) and electrical bond pads for both the initiator (1802, 1802') and the magnetic circuit coil (1804, 1804') are attached to external sources of electrical power. If no power is applied to the coil, the flexure structure (1426, 1426') maintains the shutter (1424) in the "safe" mode, with the permalloy shutter fully blocking the path between the aperture in layer one (1202) and the aperture in layer three (1710). FIG. 24(*a*) shows the shutter in the "safe" mode. In "safe" mode, even if the initiator is fired, the energetic material will not exit the aperture (1202) in layer one.

If electrical power is applied to the coil, the magnetic circuit is energized and the shutter is drawn in towards the coil. FIG. 24(*b*) shows the shutter in "armed" mode, with the aperture in the shutter aligned with the apertures in layers one and three so that energetic material may pass from the initiator material in the charge sleeve to the secondary or high explosive material that interfaces with the invention by means of the aperture (1202) in the first layer. After the shutter has been moved to "arm" mode, the initiator material contained within the charge sleeve (1806) may be ignited via the initiator electrical interface (1802,1802'). Energetic material then freely passes from the initiator to the secondary or high explosive.

The design of the flexure is such that there is a restoring force that, if power is removed from the coil, will return the shutter to the "safe" mode. The function of the shutter damping stop (1434) is to help eliminate any tendency for the shutter to oscillate or vibrate when it thereby returns to "safe" mode. The function of the damping features (1430, 1430') is not only to help eliminate any tendency for the shutter to oscillate or vibrate when it returns from armed to "safe" mode, but also to eliminate any tendency for the shutter to vibrate from the "safe" to the "armed" mode in the event of deployment in a mechanically noisy and shock prone environment.

Method of Making. One example method of building the microfabricated layers and elements of the micro-miniaturized safing device is described here. Alternative methods will be readily apparent to one skilled in the arts of precision fabrication, micro-fabrication and LIGA (LIGA is a German acronym which stands for lithography, electroplating, and molding) processing. The fabrication of the electrical circuit board and the means for winding the electrical coil are readily apparent to one skilled in the art.

In an example embodiment the invention can be microfabricated using a planar fabrication process, with each of the top three layers (upper housing, shutter and lower housing) microfabricated independently and then bonded together to form an integrated three layer shutter structure. The fourth layer, which contains a mix of micro fabricated and conventional elements, is assembled separately. The energetic material for the initiator is then loaded into the charge sleeve, and only then is the lower layer bonded to the integrated three layer shutter structure to complete the building of the device. This method of building isolates the energetic material from any microfabrication processes.

The upper and lower housing layers can be fabricated in the same fashion. Using conventional LICA and Deep X-Ray lithographic technology, a substrate can be prepared with a plating base, photoresist, and is patterned in the shape of the top of the upper housing structure (or bottom of the lower housing structure) using x-ray lithography. The photoresist is developed and permalloy plated into the pattern. The remaining photoresist can be stripped, and copper or other sacrificial material is plated and effectively replaces the photoresist that was stripped. The wafer can be planarized so that the plated permalloy structure is revealed and forms the basis for a new substrate. Photoresist is applied and the bond pad features are patterned into the photoresist. The photoresist is developed and permalloy is plated into the pattern and the structure is again planarized. The remaining photoresist is stripped and the sacrificial material is removed leaving a wafer containing complete upper and/or lower housing layers.

The shutter layer can be fabricated in two parts and then assembled. Shutter assemblies can be microfabricated in permalloy using conventional deep x-ray lithographic processes, except that the core of the coil and the extensions (1428, 1428') are not incorporated into this initial fabrication process. Rather the coil cores can be separately fabricated, wound, and then press fit and/or bonded into the body of the shutter structure. This bond line is revealed as features (1604, 1604') in the completed shutter layer and can be easily seen in FIG. 24(*a*).

The upper housing, shutter, and lower housing layers are then bonded using one of many methods that are known to those skilled in the arts. This results in a complete and integrated three layer shutter structure as described before. Then the charge sleeve can be microfabricated using conventional LIGA processing and is affixed to a miniature circuit board that comprises the main structure on the initiator layer. The assembly of the fourth layer, the initiator layer, and the bonding of that layer to the integrated three layer structure is then obvious to one skilled in the arts.

Example Acceleration Shutter Embodiments

Figure 27:
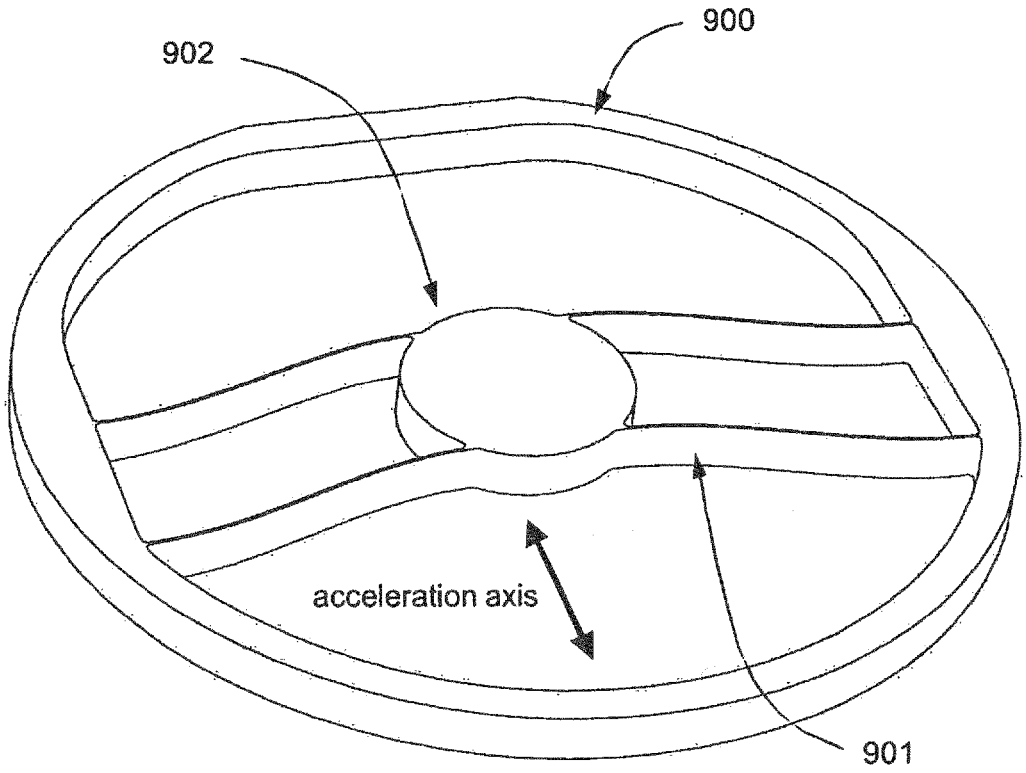
FIG. 27 is a perspective view of an example embodiment of the bistable acceleration shutter in the closed state.
Figure 28:
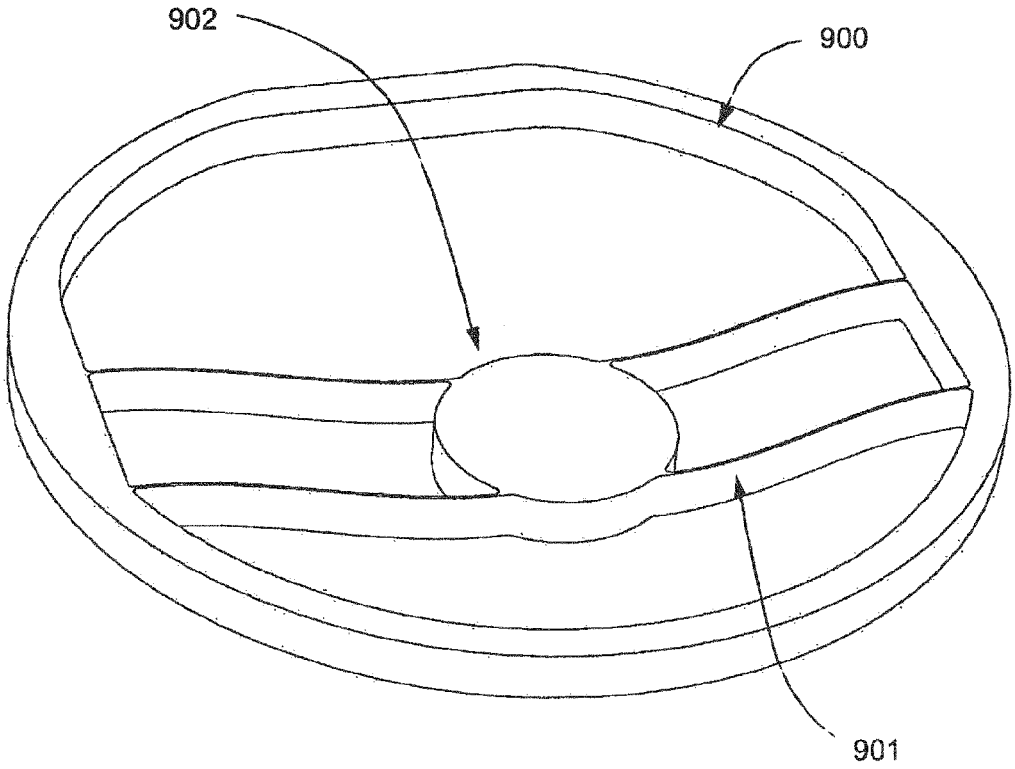
FIG. 28 is a perspective view of an example embodiment of the bistable acceleration shutter in the open state.
Figure 29:
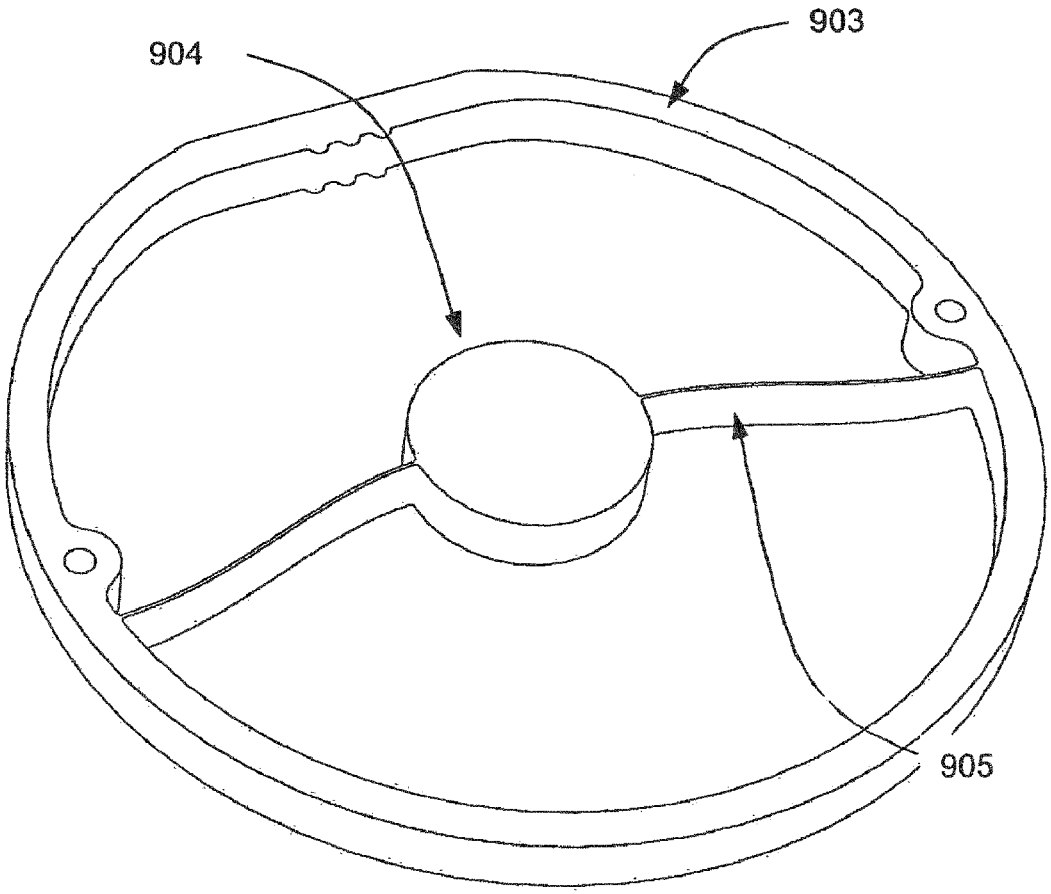
FIG. 29 is a perspective view of an example embodiment of the bistable acceleration shutter in the closed state.

FIG. 27 is an illustration of an example embodiment of a bi-stable shutter mechanism that reacts to an acceleration threshold. A center proof mass 902 is retained by the bi-stable spring element 901 that is in turn supported by an outer frame 900. The entire mechanism can be fabricated from a high yield strength metal. The proof mass 902 can be sized to be sensitive to a certain acceleration threshold in conjunction with the bi-stable spring element 901 so that when an acceleration of the mechanism is experienced which is greater than this threshold, the proof mass and spring will be forced to the other bi-stable state of the spring mass mechanism. Thus, in FIG. 28, the proof mass 902, which in this case is intended as a shutter, has experienced an acceleration above the threshold acceleration and is now positioned in the second bi-stable state. The movement of the proof mass 902 as shown in FIG. 28 which can be a shutter has now permitted an "open-state" to occur, for example. FIG. 29 shows another embodiment of the acceleration sensitive shutter whereby the proof mass is supported by a single beam 905 rather than a dual beam as in FIG. 27.

Figure 30:
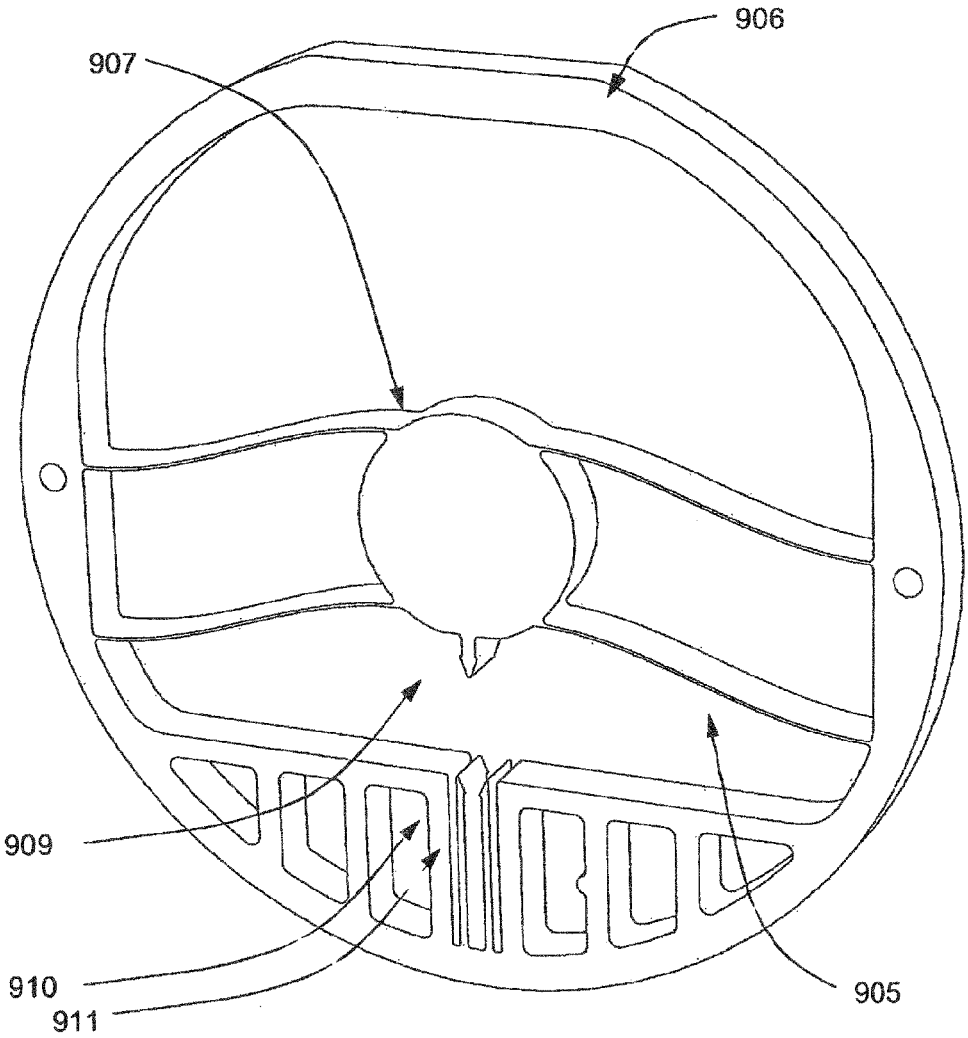
FIG. 30 is a perspective view of an example embodiment of the bistable acceleration shutter in the closed state.

In order to prevent motion of the proof mass 907 back to the original state after an acceleration threshold has been experienced, FIG. 30 shows a clamping mechanism to latch the proof mass. Consisting of a barb 909 and clamps 910, 911, the clamping mechanism will latch the proof mass into the second bistable state and prevent it from releasing back to the previous state even if a negative acceleration is experienced which would have otherwise caused the return of the proof mass and spring back to their original state.

Figure 31:
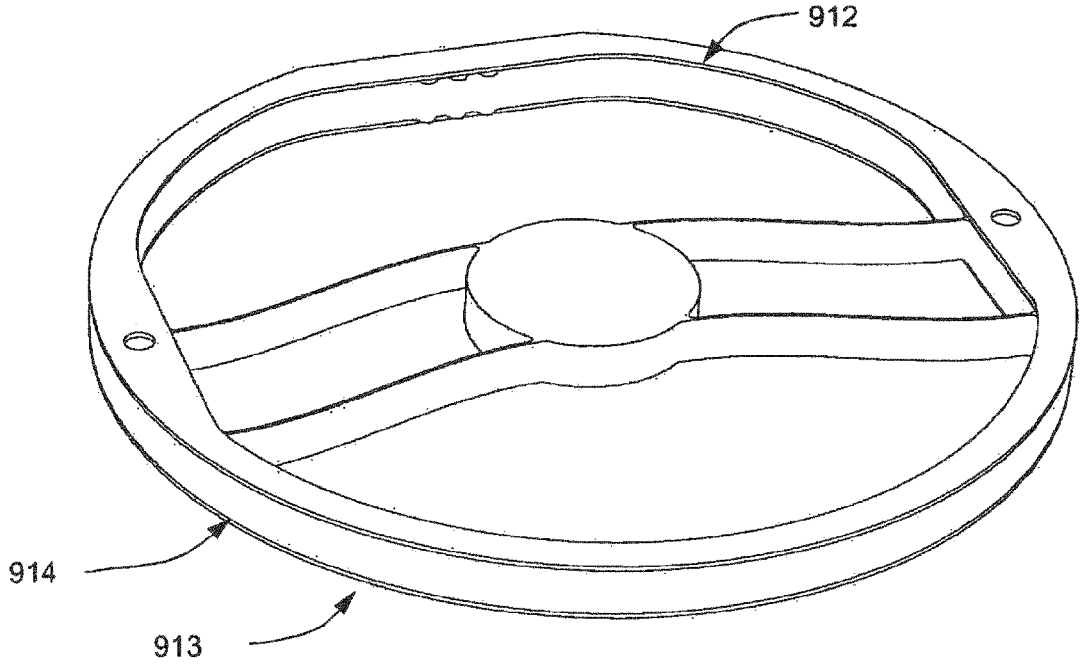
FIG. 31 is a view of an acceleration shutter with accompanying spacers.
Figure 32:
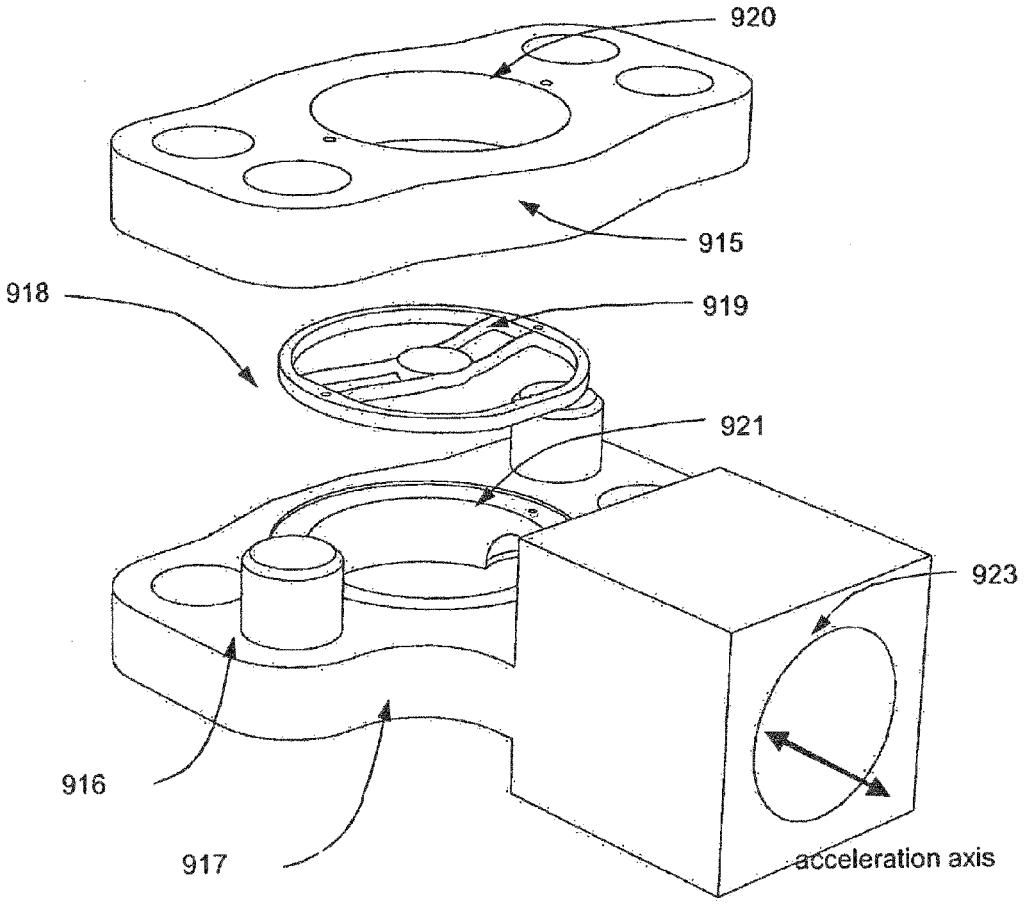
FIG. 32 is an exploded view of an example clamping assembly for holding an acceleration shutter.

FIG. 31 shows an exploded view of an example embodiment that provides for mounting of the acceleration sensitive shutter by providing spacers 912, 913 located on either side of the shuttle 914. One means to further mount the mechanism is shown in FIG. 32 where a clamping interface consisting of a top clamp 915 which is aligned over pins 916 and clamps the acceleration shutter mechanism between the top clamp 915 and lower clamp 917. Alignment holes 918, 919 are additionally provided in the acceleration shutter in order to align the acceleration shutter axis with the axis of the clamp. Thus, a pin can be inserted through an alignment hole in the top clamp 920, an alignment hole in the acceleration shutter 919 and an alignment hole in the bottom clamp 921. Alternatively, a flat 922 can be provided in the acceleration shutter frame 900 which allows alignment to the acceleration axis. A bolt hole 923 is shown which permits fixed attachment to another body.

Figure 33:
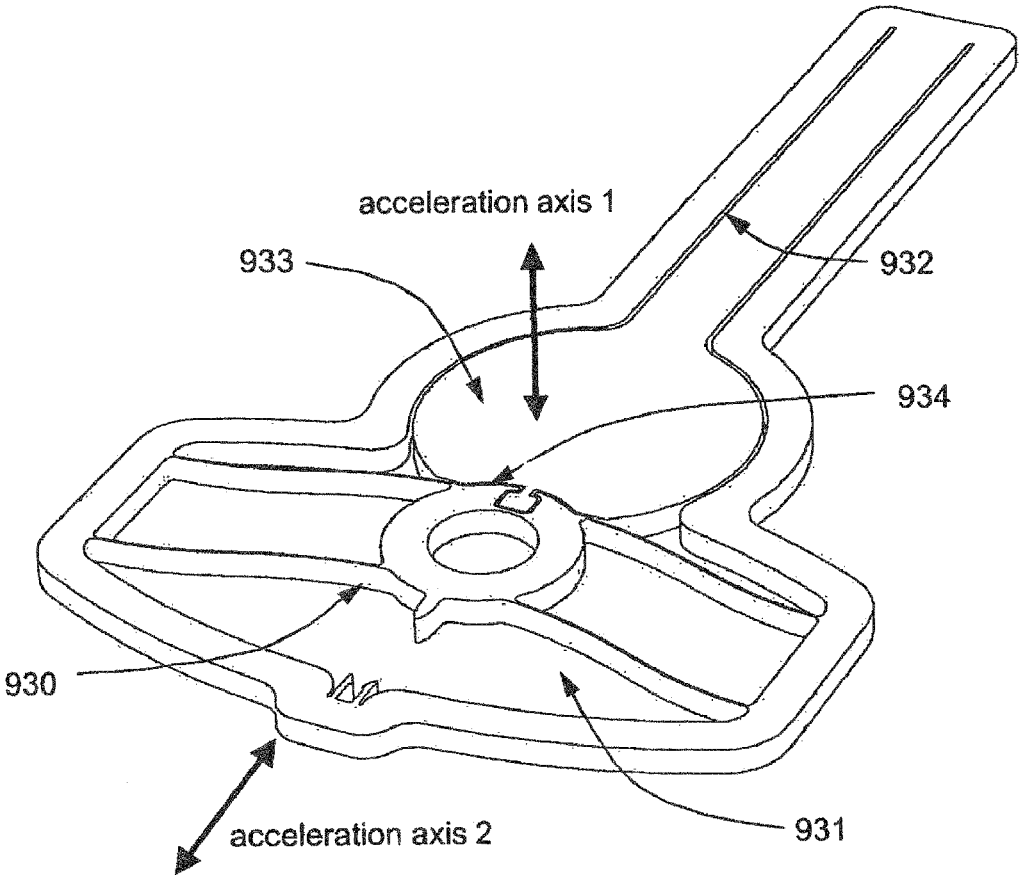
FIG. 33 is a perspective view of an example dual acceleration enabled shutter.

Another example embodiment of the acceleration threshold shutter is shown in FIG. 33 where a cantilever 932 with proof mass 933 is interlocked 934 into the proof mass 930 of a bi-stable acceleration shutter. The spring 932 can be fabricated to allow preferential motion in the direction of acceleration axis 1 so that when a certain acceleration is experienced in this direction, the proof mass 933 moves out of the plane of the mechanism thereby unlocking itself from the bi-stable acceleration shutter proof mass 930 and allowing it to move into its second stable state when it experiences an acceleration greater than the threshold acceleration in the direction of acceleration axis 2.

Figure 34:
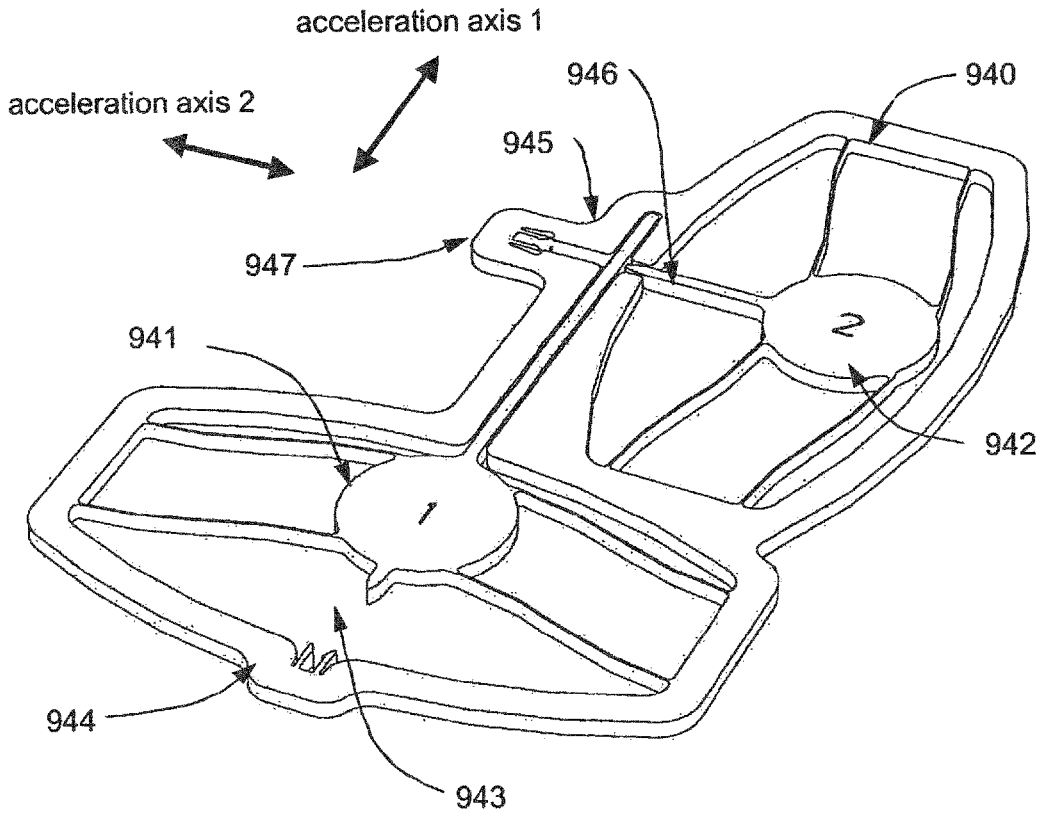
FIG. 34 is a perspective view of an example embodiment of a dual acceleration enabled shutter.
Figure 35A:
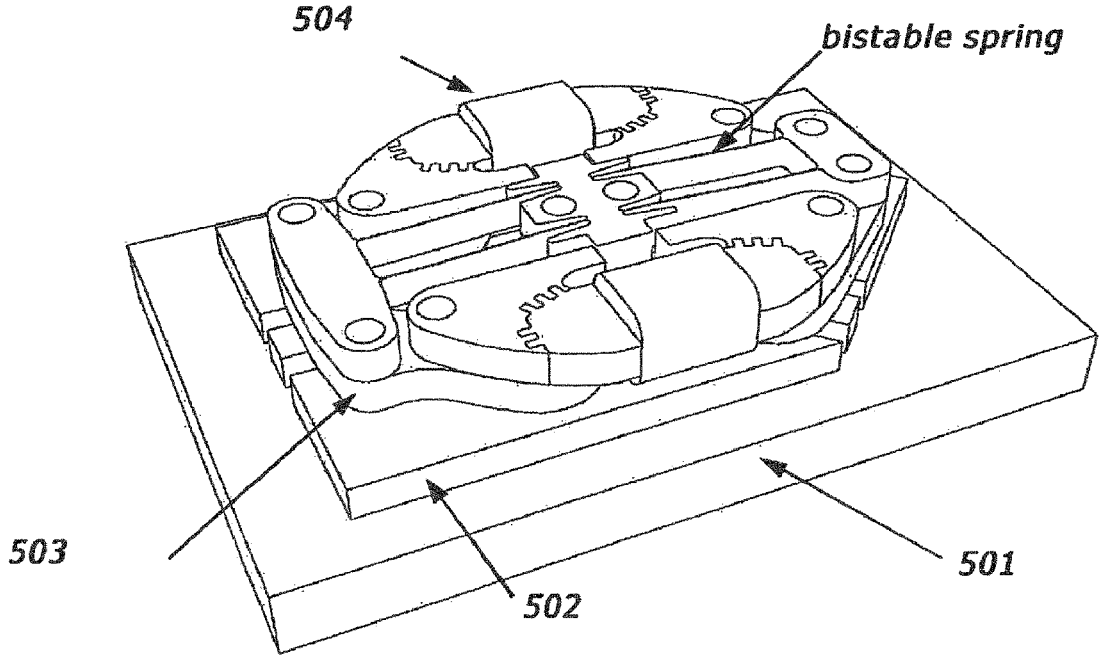
FIG. 35(*a-h*) are illustrations of an example switch embodiment.
Figure 35B:
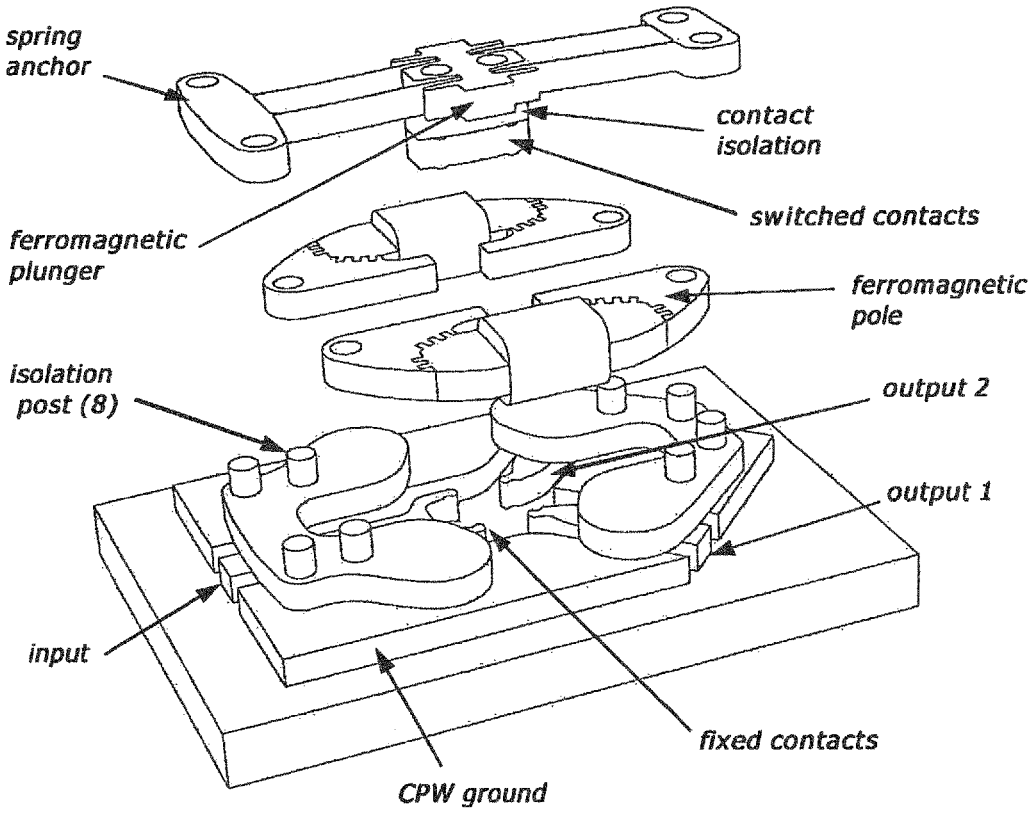
Figure 35C:
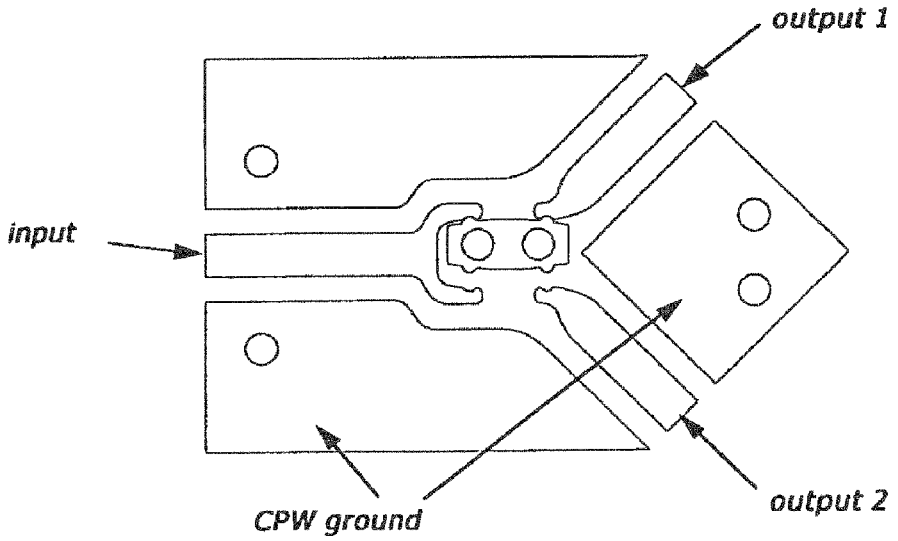
Figure 35D:
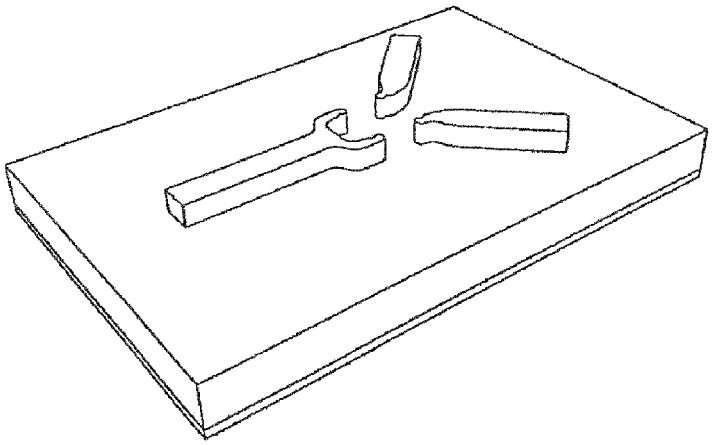
Figure 35E:
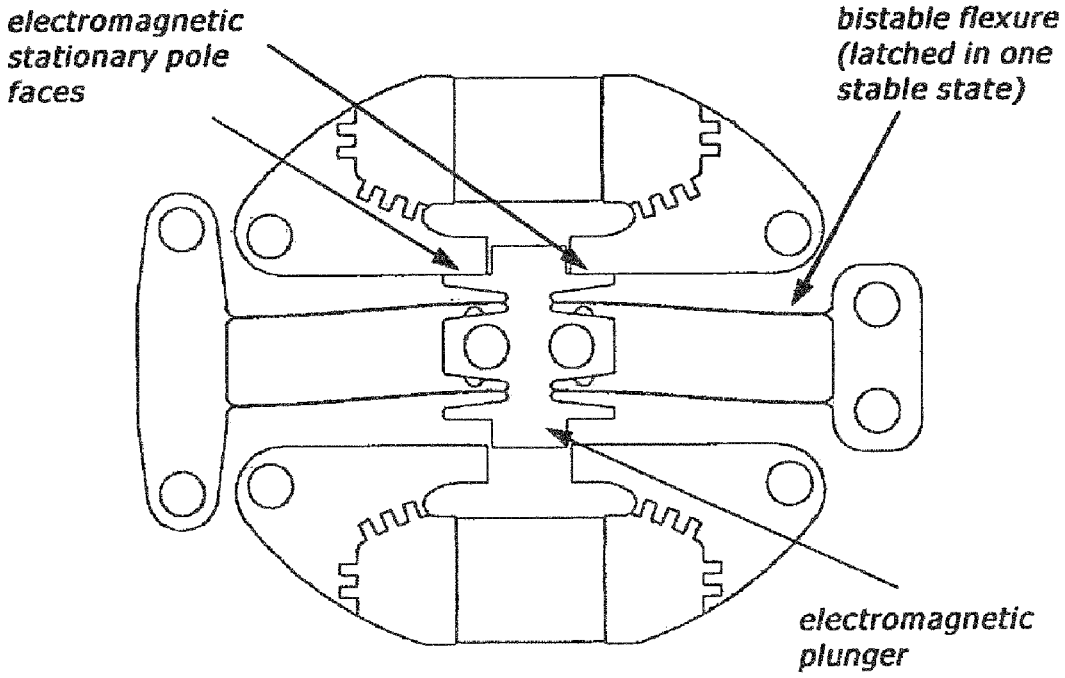

FIG. 34 shows another example embodiment, comprising a multi-directionally sensitive shutter mechanism whereby the proof mass 941 of a first acceleration threshold shutter is attached to a blocking bar 945 which in its initial state prevents the motion of a second acceleration threshold shutter with proof mass 942. The entire mechanism is supported by a common frame 940. When a sufficient acceleration is experienced along acceleration axis 1 to move proof mass 941 to its second bi-stable state, the locking bar 945 is moved to allow the motion of proof mass 942 with its barb 946 into the clamp 947 when it experiences an acceleration above its threshold value along acceleration axis 2.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

What is claimed is:

1. A switch, comprising:

(1) a substrate;

(2) a first layer of a first material that is ferromagnetic, the first layer being disposed on the substrate, and the first layer comprising:

(i) a first flexure, wherein the first flexure is substantially selectively flexible in a first direction that is substantially parallel to the substrate;

(ii) a movable member, wherein the first flexure and the movable member are mechanically connected such that the movable member is selectively movable along the first direction between a first position and a second position;

(iii) a first pad; and (iv) a second pad;

(3) first and second terminals, mounted relative to the movable member such that when the movable member is in the first position, electrical current can flow between the first and second terminals; and (4) an electromagnet comprising a coil and a core, wherein the first layer does not comprise the core, and wherein the electromagnet is mounted relative to the first layer such that the core is in physical contact with the first layer and the first pad and second pad function as north and south poles of the electromagnet, and further wherein the movable member moves between the first position and second position based on a flow of electric current in the coil.

2. The switch of claim 1, further comprising first and second contacts, where the first contact is in mechanical communication with the movable member and in electrical communication with the first terminal, and wherein the second contact is in electrical communication with the second terminal, and wherein the first and second contacts mount relative to the movable member such that the first and second contacts are in electrical communication when the movable member is in the first position but not when the movable member is in the second position.

3. The switch of claim 2, wherein the first contact moves substantially parallel to the substrate responsive to motion of the movable member.

4. The switch of claim 1, wherein the core is mechanically coupled with the first pad and second pad via a castellated mechanical interface.

5. The switch of claim 1, further comprising a housing that substantially prevents external contaminants from reaching the movable member, and that enables electrical communication with the terminals.

6. The switch of claim 5, wherein the first layer is disposed on a first side of the substrate, and wherein the terminals are externally accessible on a second side of the substrate, and wherein the housing is substantially disposed on the first side of the substrate.

7. The switch of claim 5, wherein the terminals are externally accessible in a first portion of the substrate, and wherein the housing mounts with a second portion of the substrate.

8. The switch of claim 1, wherein the movable member, first pad, second pad, and core collectively define a closed-loop path for magnetic flux.

9. A switch, comprising:

1) a substrate;

2) a first layer of a first material that is ferromagnetic, the first layer being disposed on the substrate, and the first layer comprising:

(i) a movable member that is movable between first and second positions, and where the movable member is constrained to move substantially parallel to the substrate;

(ii) a first fixed member, wherein the first fixed member and a first portion of the movable member collectively define a first gap when the first electromagnet is not energized; and (iii) a second fixed member, wherein the second fixed member and a second portion of the movable member collectively define a second gap when the first electromagnet is not energized;

3) first and second terminals, mounted relative to the movable member such that when the movable member is in the first position electrical current can flow between the first and second terminals; and 4) a first electromagnet comprising a first core surrounded by first wires, wherein the first layer does not comprise the first core;

wherein the first core is physically and magnetically coupled with each of the first fixed member and second fixed member such that the first fixed member functions as a first pole of the electromagnet and the second fixed member functions as a second pole of the electromagnet, and wherein an electric current in the first wires induces a first magnetic flux through each of the first gap and the second gap, and further wherein the first magnetic flux induces a first force that moves the movable member between the first position and the second position.

10. The switch of claim 9, wherein the first portion and the first fixed member are in physical contact when the electromagnet is energized, and wherein the second portion and the second fixed member are in physical contact when the electromagnet is energized.

11. The switch of claim 9 further comprising:

a third fixed member, wherein the third fixed member and a third portion of the movable member collectively define a third gap when the second electromagnet is not energized, and wherein the first layer comprises the third fixed member;

a fourth fixed member, wherein the fourth fixed member and a fourth portion of the movable member collectively define a fourth gap when the second electromagnet is not energized, and wherein the first layer comprises the fourth fixed member;

a third terminal, mounted relative to the movable member such that when the movable member is in the second position electrical current can flow between the first and third terminals; and a second electromagnet comprising a second core surrounded by second wires, wherein the first layer does not comprise the second core;

wherein the second core is physically and magnetically coupled with each of the third fixed member and fourth fixed member such that the third fixed member functions as a first pole of the second electromagnet and the fourth fixed member functions as a second pole of the second electromagnet, and wherein a second electric current in the second wires induces a second magnetic flux through each of the third gap and fourth gap, and further wherein the second magnetic flux induces a second force that moves the movable member between the first and second position.

12. The switch of claim 9, wherein the first layer defines a first plane, and wherein first electromagnet is mounted relative to the first layer such that the first core is not in the first plane.

13. The switch of claim 9, wherein the core is mechanically coupled with each of the first fixed member and second fixed member via a castellated mechanical interface.

14. The switch of claim 9, wherein the movable member, first fixed member, second fixed member, and core collectively define a closed-loop path for magnetic flux.

15. A microfabricated switch comprising:

(1) a substrate;

(2) a first layer of a first material that is ferromagnetic, the first layer being disposed on the substrate, and the first layer comprising:

(i) a movable member that is dimensioned and arranged to move along a direction substantially parallel with the substrate;

(ii) a first terminal and second terminal, mounted relative to the movable member such that (i) when the movable member is in a first position a flow of a first electrical current between the first and second terminals is enabled and (ii) when the movable member is in a second position the flow of the first electrical current between the first and second terminals is disabled; and (iii) a first fixed member and second fixed member, the first fixed member and second fixed member each comprising ferromagnetic material; and (3) an electromagnet comprising:

(i) a core comprising ferromagnetic material, wherein the core is not included in the first layer; and (ii) a winding that is dimensioned and arranged to enable the flow of a second electrical current through the winding;

wherein the core, first fixed member, and second fixed member are physically coupled such that the first fixed member comprises a first pole of the electromagnet and the second fixed member comprises a second pole of the electromagnet; and wherein the position the movable member is based the flow of the second electrical current.

16. The switch of claim 15 wherein the first layer defines a first plane, and wherein the core lies in a second plane that is entirely outside the first plane.

17. The switch of claim 15 wherein the first layer defines a first plane, and wherein the core lies entirely within the first plane.

18. The switch of claim 15 wherein the movable member is in the first position when the second electrical current flows through the winding.

19. The switch of claim 15 wherein the movable member is in the second position when the second electrical current flows through the winding.

20. The switch of claim 15, wherein the movable member, first fixed member, second fixed member, and core collectively define a closed-loop path for magnetic flux.

* * * * *